US009438979B2

(12) United States Patent
Dehe

(10) Patent No.: US 9,438,979 B2
(45) Date of Patent: Sep. 6, 2016

(54) MEMS SENSOR STRUCTURE FOR SENSING PRESSURE WAVES AND A CHANGE IN AMBIENT PRESSURE

(71) Applicant: Infineon Technologies AG, Neubiberg (DE)

(72) Inventor: Alfons Dehe, Reutlingen (DE)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 14/198,634

(22) Filed: Mar. 6, 2014

(65) Prior Publication Data

US 2015/0256913 A1 Sep. 10, 2015

(51) Int. Cl.

| | |
|---|---|
| ***H04R 25/00*** | (2006.01) |
| ***H04R 1/08*** | (2006.01) |
| ***H04R 17/02*** | (2006.01) |
| ***H04R 19/00*** | (2006.01) |
| ***H04R 19/04*** | (2006.01) |
| ***H04R 31/00*** | (2006.01) |

(52) U.S. Cl.

CPC ..... *H04R 1/08* (2013.01); *H04R 17/02* (2013.01); *H04R 19/005* (2013.01); *H04R 19/04* (2013.01); *H04R 31/00* (2013.01); *H04R 2201/003* (2013.01); *H04R 2207/00* (2013.01); *H04R 2499/11* (2013.01)

(58) Field of Classification Search

CPC ..... H04R 1/08; H04R 19/00; H04R 23/006; H04R 31/00

See application file for complete search history.

(56) References Cited

U.S. PATENT DOCUMENTS

| | | | | |
|---|---|---|---|---|
| 6,075,867 | A * | 6/2000 | Bay et al. | 381/191 |
| 2014/0126762 | A1* | 5/2014 | Zoellin et al. | 381/355 |
| 2015/0001647 | A1 | 1/2015 | Dehe et al. | |

OTHER PUBLICATIONS

Chuanche Wang, Bishnu P. Gogoi, David J. Monk, Carlos H. Mastangelo, Contamination-Insensitive Differential Capacitive Pressure Sensors, Journal of Microelectromechanical Systems, vol. 9, No. 4, Dec. 2000, USA, pp. 538-543.

Jesper Bay, Ole Hansen, Siebe Bouwstra, Design of a silicon microphone with differential read-out of a sealed double parallel-plate capacitor, The 8th International Conference on Silid-State Sensors and Actuators, and Eurosensors IX, Stockholm, Jun. 25-29, 1995, Microelectronics Centre, Technical University of Denmark, Lyngby, Denmark, pp. 700-703.

* cited by examiner

*Primary Examiner* — Tuan D Nguyen

(74) *Attorney, Agent, or Firm* — Viering, Jentschura & Partner mbB

(57) ABSTRACT

A sensor structure, including: a first diaphragm structure, an electrode element, and a second diaphragm structure arranged on an opposite side of the electrode element from the first diaphragm structure is disclosed. The sensor structure may also include a chamber formed by the first and second diaphragm structures, where the pressure in the chamber is lower than the pressure outside of the chamber. A method for forming the sensor structure is likewise disclosed.

14 Claims, 18 Drawing Sheets

MEMS SENSOR STRUCTURE FOR SENSING PRESSURE WAVES AND A CHANGE IN AMBIENT PRESSURE

TECHNICAL FIELD

Various embodiments relate generally to a sensor structure containing a first diaphragm structure, a second diaphragm, an electrode element arranged between the respective diaphragm elements, and a circuit configured to process at least one signal generated by a deflection of the first diaphragm structure and a deflection of the second diaphragm structure.

BACKGROUND

A typical microphone has a diaphragm that is exposed to incident pressure waves. These pressure waves cause the diaphragm to deflect and this deflection is detected by various transduction mechanisms and converted into an electric signal. In a micro-electro-mechanical system (MEMS) microphone, conventional transduction mechanisms may include piezoelectric, piezoresistive, optical, and capacitive mechanisms. A simple MEMS microphone may be a capacitor consisting of a counter electrode, more commonly referred to as a "backplate", and a diaphragm. When a voltage is applied across the backplate/diaphragm capacitive system, and sound waves cause the diaphragm to oscillate, the sound waves can be converted into useable electrical signals by measuring the change in capacitance caused by the movement of the diaphragm relative to the backplate. Many MEMS pressure sensors likewise employ the various transduction mechanisms discussed above to sense a change in atmospheric pressure.

SUMMARY

In various embodiments, a sensor structure is provided. The sensor structure may include a first diaphragm structure; an electrode element; and a second diaphragm structure arranged on an opposite side of the electrode element from the first diaphragm structure; where the first diaphragm structure and the second diaphragm structure may form a chamber where the pressure in the chamber may be lower than the pressure outside of the chamber.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

The following detailed description refers to the accompanying drawings that show, by way of illustration, specific details and embodiments in which the disclosure may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

According to various embodiments, a double diaphragm MEMS sensor structure, where an electrode element may be arranged between the diaphragm elements, is provided. According to various embodiments, said double diaphragm MEMS sensor structure may be capable of simultaneously sensing both pressure waves and changes in ambient atmospheric pressure. Thus, the sensing capabilities of the MEMS sensor structure may be improved.

In various embodiments, a diaphragm may include a plate or a membrane. A plate may be understood as being a diaphragm being under pressure. Furthermore, a membrane may be understood as being a diaphragm being under tension. Although various embodiments will be described in more detail below with reference to a membrane, it may be alternatively provided with a plate, or in general with a diaphragm.

Figure 1A:
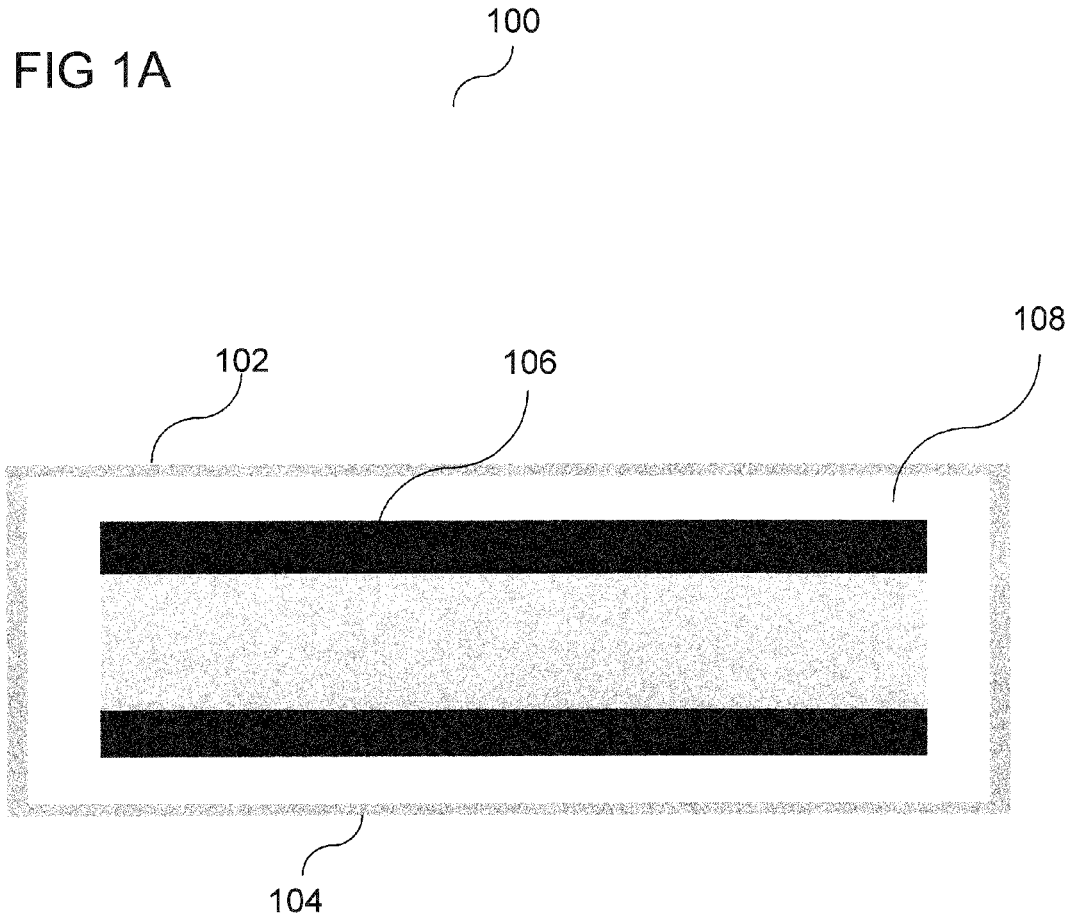
FIG. 1A shows a perspective cross sectional view of a double diaphragm MEMS sensor structure.

According to various embodiments, FIG. 1A is a cross-sectional, highly abstracted view of a double membrane MEMS sensor structure 100, which may contain a first membrane structure 102, a second membrane structure 104, an electrode element 106, and a chamber 108 formed by the two membrane elements 102 and 104, respectively.

According to various embodiments, the pressure inside the chamber 108 may be lower than the pressure outside the chamber. The pressure inside the chamber 108 may substantially be a vacuum.

Figure 1B:
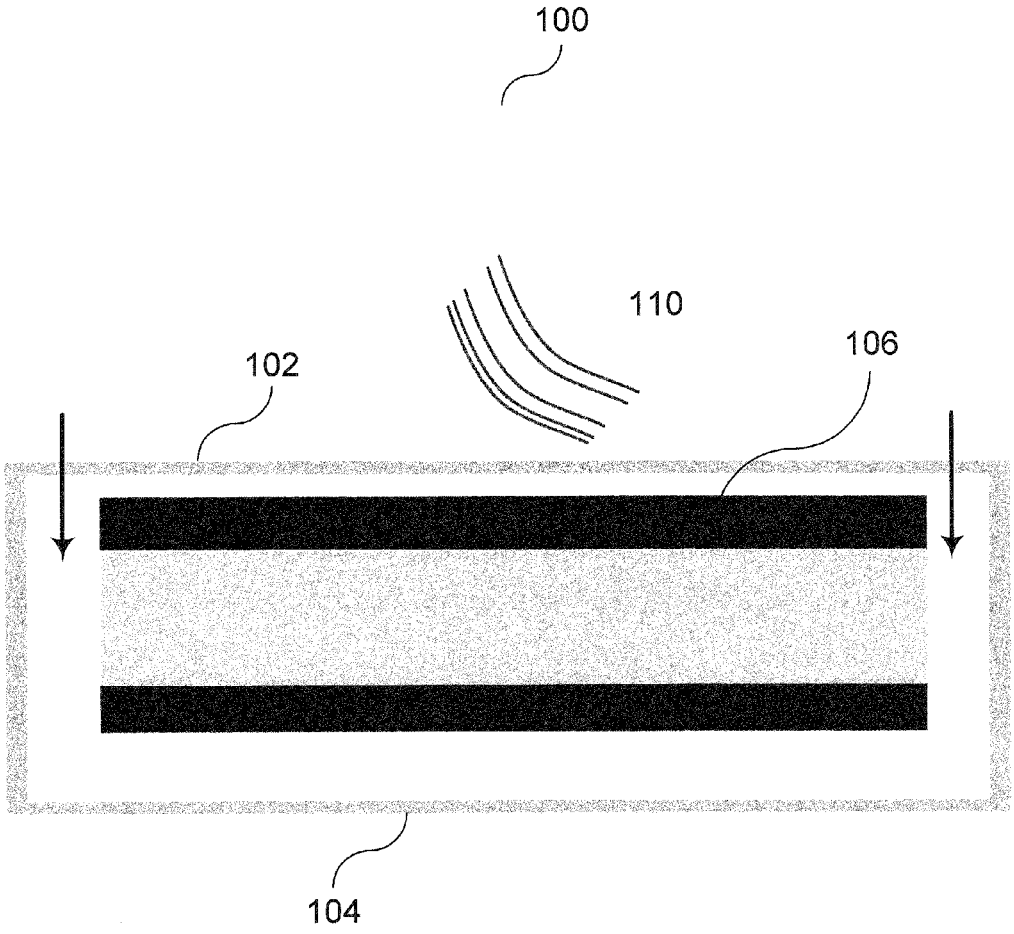
FIG. 1B shows the double diaphragm MEMS sensor structure of FIG. 1A, where pressure waves are causing the double diaphragm structure to deflect from a rest position.

According to various embodiments, sound waves 110, incident on the chamber 108 may cause the chamber to deflect relative to the electrode element 106, e.g. as shown in FIG. 1B, as the chamber 108 deflects due to the sound waves 110, the first membrane structure 102 may deflect in a direction substantially toward the electrode element 106 while the second membrane structure 104 may simultaneously be deflected in substantially the same direction as the first membrane structure 102 and therefore may move away from the electrode element 106.

Figure 1C:
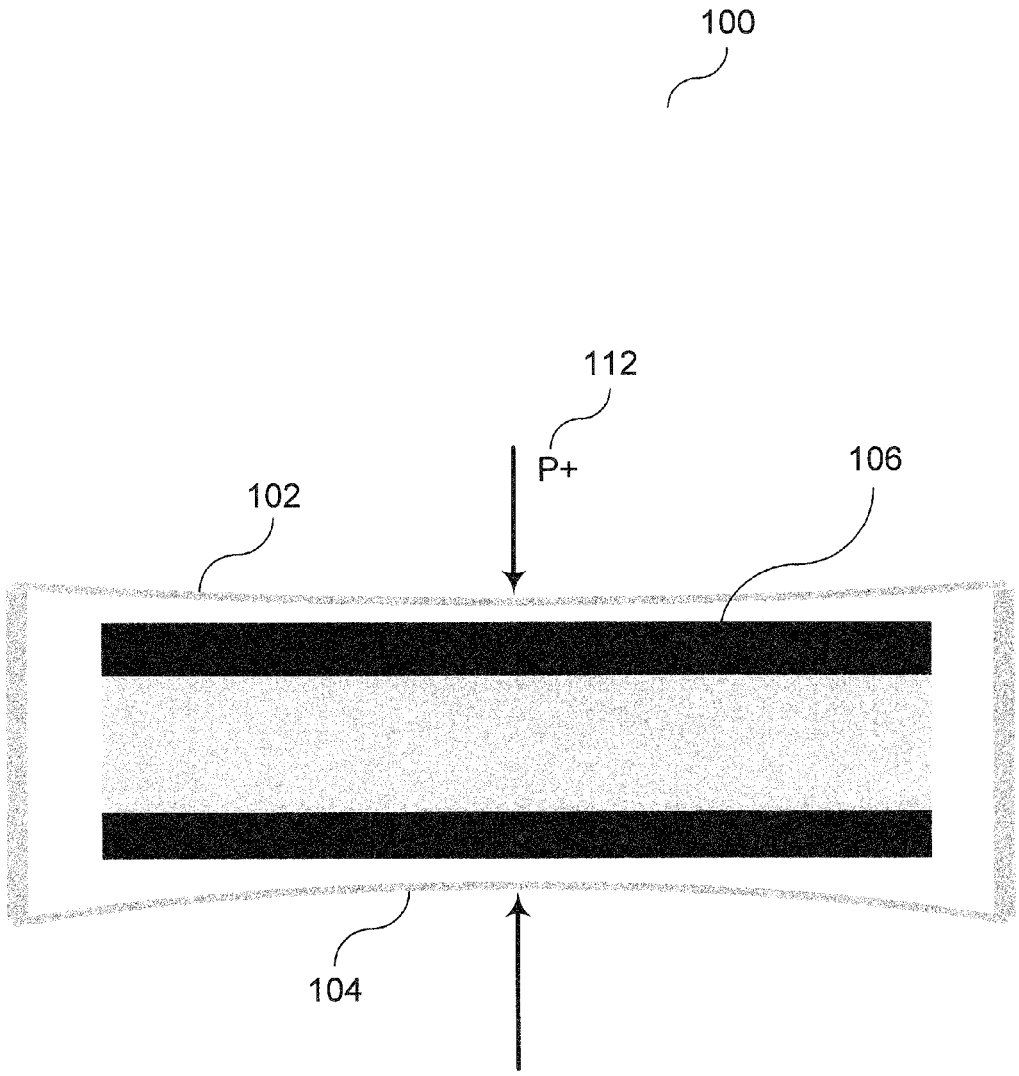
FIG. 1C shows the double diaphragm MEMS sensor structure of FIG. 1A, where a change in ambient pressure is causing the diaphragm structures to deflect from a rest position.

According to various embodiments, as shown in FIG. 1C, an increased ambient pressure, P+ (designated with reference numeral 112), outside the chamber 108 may cause the first membrane structure 102 and the second membrane structure 104 to deflect substantially toward the electrode element 106.

According to various embodiments, electrical signals may be generated by the movement of membrane structures 102 and 104. The electrical signals may then be compared by one or more processing circuits (not shown) and converted to useable information as may be desirable for a given application, e.g. sensing a change in pressure, e.g. detecting the magnitude of pressure waves incident on the membrane structures 102 and 104.

Figure 2:
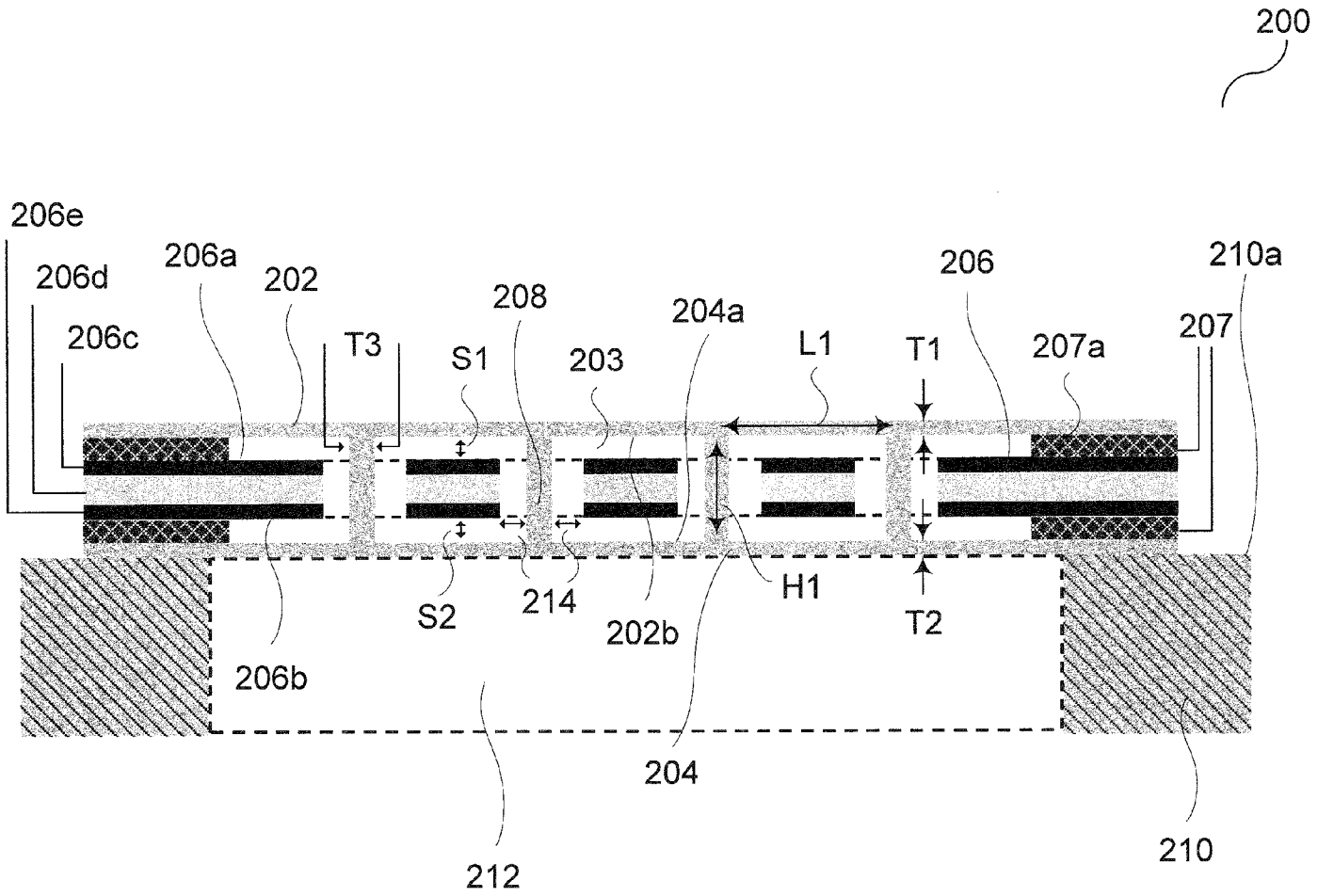
FIG. 2 shows a cross sectional view of a double diaphragm MEMS sensor structure in accordance with various embodiments.

According to various embodiments, as illustrated in FIG. 2, the double-membrane MEMS sensor structure 200 may include a first membrane structure 202, a second membrane structure 204, and an electrode element 206, where the first membrane structure 202 and the second membrane structure 204 are arranged to create a chamber 203.

According to various embodiments, the pressure inside the chamber 203 may be less than the pressure inside the chamber 203. The pressure inside the chamber 203 may substantially be a vacuum.

The double-membrane MEMS sensor structure 200 may further include at least one pillar structure 208 arranged between the first membrane structure 202 and the second membrane structure 204. According to various embodiments, the double-membrane MEMS sensor structure 200 may further include a support structure 210 and a cavity 212 formed in the support structure 210. According to various embodiments, the double-membrane MEMS sensor structure 200 may further include an insulating layer 207, arranged to insulate the first membrane structure 202 and the second membrane structure from making electrical contact with the electrode element 206.

According to various embodiments, the support structure 210 may be a semiconductor substrate, such as a silicon substrate. According to various embodiments, the support structure 210 may include or may be composed of other semiconductor materials such as germanium, silicon germanium, silicon carbide, gallium nitride, indium, indium gallium nitride, indium gallium arsenide, indium gallium zinc oxide, or other elemental and/or compound semiconductors (e.g. a III-V compound semiconductor such as e.g. gallium arsenide or indium phosphide, or a II-VI compound semiconductor or a ternary compound semiconductor or a quaternary compound semiconductor) as may be desired for a given application.

According to various embodiments, the cavity 212 may formed in the support structure 210 through various etching techniques, e.g. isotropic gas phase etching, vapor etching, wet etching, isotropic dry etching, plasma etching, etc.

According to various embodiments, the cavity 212 may be square or substantially square in shape. According to various embodiments, the cavity 212 may be rectangular or substantially rectangular in shape. According to various embodiments, the cavity 212 may be a circle or substantially circular in shape. According to various embodiments, the cavity 212 may be an oval or substantially oval in shape. According to various embodiments, the cavity 212 may be a triangle or substantially triangular in shape. According to various embodiments, the cavity 212 may be a cross or substantially cross shaped. According to various embodiments, the cavity 212 may be formed into any shape that may be desired for a given application.

The second membrane structure 204 may be formed over the top surface 210*a* of the support structure 210 through various fabrication techniques, e.g. physical vapor deposition, electrochemical deposition, chemical vapor deposition, and molecular beam epitaxy. According to various embodiments, the second membrane structure 204 may be formed over the top surface 210*a* of the support structure 210 before the cavity 212 is formed in the support structure 210.

According to various embodiments, the second membrane structure 204 may be square or substantially square shaped. The second membrane structure 204 may be rectangular or substantially rectangular in shape. According to various embodiments, the second membrane structure 204 may be a circle or substantially circular in shape. The second membrane structure 204 may be an oval or substantially oval in shape. The second membrane structure 204 may be a triangle or substantially triangular in shape. The second membrane structure 204 may be a cross or substantially cross-shaped. According to various embodiments, the second membrane structure 204 may be formed into any shape that may desired for a given application.

According to various embodiments, the second membrane structure 204 may be composed of or may include a semiconductor material such as, e.g. silicon. According to various embodiments, the second membrane structure 204 may include or may be composed of other semiconductor materials such as germanium, silicon germanium, silicon carbide, gallium nitride, indium, indium gallium nitride, indium gallium arsenide, indium gallium zinc oxide, or other elemental and/or compound semiconductors (e.g. a III-V compound semiconductor such as e.g. gallium arsenide or indium phosphide, or a II-VI compound semiconductor or a ternary compound semiconductor or a quaternary compound semiconductor) as desired for a given application. According to various embodiments, the second membrane structure 204 may be composed of or may include at least one of a metal, a dielectric material, a piezoelectric material, a piezoresistive material, and a ferroelectric material.

According to various embodiments, a thickness T2 of the second membrane structure 204 may be, for example, in the range from 300 nm to 10 μm, e.g. in the range from 300 nm to 400 nm, e.g. in the range from 400 nm to 500 nm, e.g. in the range from 500 nm to 1 μm, e.g. in the range from 1 μm to 3 μm, e.g. in the range from 3 μm to 5 μm, e.g. from 5 μm to 10 μm.

According to various embodiments, as illustrated in FIG. 2, at least a portion of the insulating layer 207 may be arranged between a bottom surface 206*b* of the electrode element 206 and a top surface 204*a* of the second membrane structure 204.

As illustrated in FIG. 2, at least a portion of the insulating layer 207 may be arranged between a top surface 206*a* of the electrode element 206 and a bottom surface 202*b* of the first membrane structure 202.

According to various embodiments, the first membrane structure 202, the electrode element 206, the second membrane structure 204, and the insulating layer 207 may be arranged in a stack structure. In other words, the insulating layer may enclose at least a portion of each of the first membrane structure 202, the electrode element 206, the second membrane structure 204. The first membrane structure 202, the electrode element 206, the second membrane structure 204, and the insulating layer 207 may be implemented as a type of laminate structure. According to various embodiments, the insulating layer 207 may at least partially attach and/or fix the first membrane structure 202, the electrode element 206, the second membrane structure 204 to the support structure 210.

According to various embodiments, the insulating layer 207 may be composed of or may include various dielectrics, such as, for example, a silicon oxide, silicon nitride, tetraethyl orthosilicate, borophosphosilicate glass, and various plasma oxides.

According to various embodiments, the portion of the insulating layer 207 which may extend between the bottom surface 206*b* of the electrode element 206 and the top surface 204*a* of the second membrane structure 204 may have a thickness in the range, e.g. from about 300 nm to 10 μm, e.g. in the range from 300 nm to 400 nm, e.g. in the range from 400 nm to 500 nm, e.g. in the range from 500 nm to 1 μm, e.g. in the range from 1 μm to 3 μm, e.g. in the range from 3 μm to 5 μm, e.g. in the range from 5 μm to 10 μm.

According to various embodiments, the portion of the insulating layer 207 which may extend between the top surface 206*a* of the electrode element 206 and the bottom surface 202*b* of the first membrane structure 202 may have a thickness in the range, e.g. from about 300 nm to 10 μm, e.g. in the range from 300 nm to 400 nm, e.g. in the range from 400 nm to 500 nm, e.g. in the range from 500 nm to 1 μm, e.g. in the range from 1 μm to 3 μm, e.g. in the range from 3 μm to 5 μm, e.g. in the range from 5 μm to 10 μm.

According to various embodiments, a distance between the top surface 206*a* of the electrode element 206 and the bottom surface 202*b* of the first membrane structure 202 may be defined as a first sensing gap S1.

According to various embodiment, the first sensing gap S1 may be in the range, e.g. from about 300 nm to 10 μm, e.g. in the range from 300 nm to 400 nm, e.g. in the range from 400 nm to 500 nm, e.g. in the range from 500 nm to 1 μm, e.g. in the range from 1 μm to 3 μm, e.g. in the range from 3 μm to 5 μm, e.g. in the range from 5 μm to 10 μm.

According to various embodiments, a distance between the bottom surface 206*b* of the electrode element 206 and a top surface 204*a* of the second membrane structure 204 may be defined as a second sensing gap S2.

According to various embodiment, the second sensing gap S2 may be in the range, e.g. from about 300 nm to 10 μm, e.g. in the range from 300 nm to 400 nm, e.g. in the range from 400 nm to 500 nm, e.g. in the range from 500 nm to 1 μm, e.g. in the range from 1 μm to 3 μm, e.g. in the range from 3 μm to 5 μm, e.g. in the range from 5 μm to 10 μm.

According to various embodiments, as illustrated in FIG. 2, the electrode element 206 may include a first conductive layer 206*c*, an electrical insulation layer 206*d*, and a second conductive layer 206*e*. According to various embodiments, the first conductive layer 206*c* and the second conductive layer 206*e* may be composed of the same conductive material. According to various embodiments, the first conductive layer 206*c* and the second conductive layer 206*e* may be composed of the different conductive material.

According to various embodiments the first conductive layer 206*c* of the electrode element 206 may be comprised of or may include various metals, e.g. aluminum, silver, copper, nickel, and various alloys such as aluminum-silver and cupronickel.

According to various embodiments the first conductive layer 206*c* of the electrode element 206 may be comprised of or may include various semiconductor materials which may be doped such that they are electrically conductive, e.g. a polysilicon layer heavily doped with boron, phosphorus, or arsenic.

According to various embodiments the first conductive layer 206*c* of the electrode element 206 may have a thickness in the range from about 500 nm to about 5 μm, e.g. in the range from about 500 μm to about 1 μm, e.g. in the range from about 1 μm to about 2 μm, e.g. in the range from about 2 μm to about 3 μm, e.g. in the range from about 3 μm to about 4 μm, e.g. in the range from about 4 μm to about 5 μm.

According to various embodiments the electrical insulation layer 206*d* of the electrode element 206 may be comprised of or may include various dielectric materials, such as, for example, a silicon oxide, silicon nitride, tetraethyl orthosilicate, borophosphosilicate glass, and various plasma oxides. According to various embodiments the electrical insulation layer 206*d* may be comprised of or may include various semiconductor materials such as, silicon dioxide, germanium, silicon germanium, silicon carbide, gallium nitride, indium, indium gallium nitride, indium gallium arsenide, indium gallium zinc oxide, or other elemental and/or compound semiconductors (e.g. a III-V compound semiconductor such as e.g. gallium arsenide or indium phosphide, or a II-VI compound semiconductor or a ternary compound semiconductor or a quaternary compound semiconductor) as desired for a given application.

According to various embodiments the second conductive layer 206*e* of the electrode element 206 may be comprised of or may include various metals, e.g. aluminum, silver, copper, nickel, and various alloys such as aluminum-silver and cupronickel.

According to various embodiments the second conductive layer 206*e* of the electrode element 206 may be comprised of or may include various semiconductor materials which may be doped such that they are electrically conductive, e.g. a polysilicon layer heavily doped with boron, phosphorus, or arsenic.

According to various embodiments the second conductive layer 206*e* of the electrode element 206 may have a thickness in the range from about 500 nm to about 5 μm, e.g. in the range from about 500 nm to about 1 μm, e.g. in the range from about 1 μm to about 2 μm, e.g. in the range from about 2 μm to about 3 μm, e.g. in the range from about 3 μm to about 4 μm, e.g. in the range from about 4 μm to about 5 μm.

According to various embodiments, the first membrane structure 202 may be formed over the top surface 207*a* of the insulating layer 207 through various fabrication techniques, e.g. physical vapor deposition, electrochemical deposition, chemical vapor deposition, and molecular beam epitaxy.

According to various embodiments, the first membrane structure 202 may be square or substantially square shaped. According to various embodiments, the first membrane structure 202 may be rectangular or substantially rectangular in shape. According to various embodiments, the first membrane structure 202 may be a circle or substantially circular in shape. According to various embodiments, the first membrane structure 202 may be an oval or substantially oval in shape. According to various embodiments, the first membrane structure 202 may be a triangle or substantially triangular in shape. According to various embodiments, the first membrane structure 202 may be a cross or substantially cross-shaped. According to various embodiments, the first membrane structure 202 may be formed into any shape that may desired for a given application.

According to various embodiments, the first membrane structure 202 may be composed of or may include a semiconductor material such as, e.g. silicon. According to various embodiments, the first membrane structure 202 may include or may be composed of other semiconductor materials such as germanium, silicon germanium, silicon carbide, gallium nitride, indium, indium gallium nitride, indium gallium arsenide, indium gallium zinc oxide, or other elemental and/or compound semiconductors (e.g. a III-V compound semiconductor such as e.g. gallium arsenide or indium phosphide, or a II-VI compound semiconductor or a ternary compound semiconductor or a quaternary compound semiconductor) as desired for a given application. According to various embodiments, the first membrane structure 202 may be composed of or may include at least one of a metal, a dielectric material, a piezoelectric material, a piezoresistive material, and a ferroelectric material.

According to various embodiments, a thickness T1, of the first membrane structure 202, may be for example, in the range from 300 nm to 10 μm, e.g. in the range from 300 nm to 400 nm, e.g. in the range from 400 nm to 500 nm, e.g. in the range from 500 nm to 1 μm, e.g. in the range from 1 μm to 3 μm, e.g. in the range from 3 μm to 5 μm, e.g. in the range from 5 μm to 10 μm.

Figure 4A:
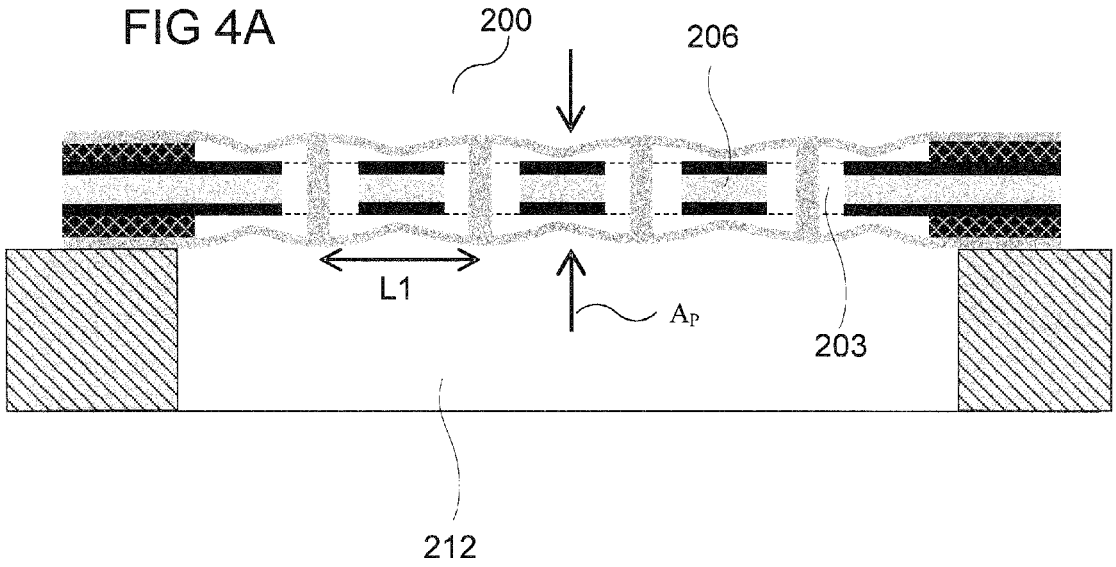
FIG. 4A shows the double diaphragm MEMS sensor structure of FIG. 3B where a chamber may be formed by the diaphragm structures and the pressure in the chamber may be lower that the pressure outside the chamber, as a result of the low pressure inside the chamber, an undesired deflection of the diaphragm structures toward the electrode element may result in accordance with various embodiments.

According to various embodiments, as illustrated in FIG. 4A, due to the vacuum and/or low-pressure in the chamber 203, the first and second membrane structures 202 and 204, respectively, may be loaded by an ambient pressure, $A_p$, resulting in an undesired deflection of the membrane structures 202 and 204 toward the electrode element 206. According to various embodiments, this unwanted deflection may be remedied by the addition of the at least one pillar structure 208.

According to various embodiments, the at least one pillar structure 208 may be arranged between the bottom surface 202*b* of the first membrane structure 202 and the top surface 204*a* of the second membrane structure 204.

According to various embodiments, the at least one pillar structure 208 be formed over the top surface 204*a* of the second membrane structure 204 through various fabrication techniques, e.g. physical vapor deposition, electrochemical deposition, chemical vapor deposition, and molecular beam epitaxy.

According to various embodiments, the at least one pillar structure 208 may be arranged between the bottom surface 202*b* of the first membrane structure 202 and the top surface 204*a* of the second membrane structure 204 to mechanically couple and/or fix the first membrane structure 202 to the second membrane structure 204. In various embodiments where the first membrane structure 202 may be mechanically coupled to the second membrane structure 204 by the at least one pillar structure 208, a displacement and/or deflection of either membrane structure may cause a proportional displacement and/or deflection of the other membrane structure. In other words, according to various embodiments, the at least one pillar structure 208 may mechanically couple and/or fix the first membrane structure 202 to the second membrane structure 204 such that the first and second membrane structures 202 and 204 become substantially the same structure.

According to various embodiments, the at least one pillar structure 208 be arranged between the bottom surface 202*b* of the first membrane structure 202 and the top surface 204*a* of the second membrane structure 204 to electrically couple the first membrane structure 202 to the second membrane structure 204.

According to various embodiments, the at least one pillar structure 208 be arranged between the bottom surface 202*b* of the first membrane structure 202 and the top surface 204*a* of the second membrane structure 204 to electrically isolate the first membrane structure 202 from the second membrane structure 204.

According to various embodiments, the at least one pillar structure 208 may have a height, H1, for example in the range from about 1 μm to about 10 μm, e.g. in the range from about 1 μm to about 2 μm, e.g. in the range from about 2 μm to about 2.5 μm, e.g. in the range from about 2.5 μm to about 5 μm, e.g. in the range from about 5 μm to about 7 μm, e.g. in the range from about 7 μm to about 10 μm. According to various embodiments, the thickness, T3 of the at least one pillar structure 208 may be for example, in the range from about 300 nm to about 10 μm, e.g. in the range from about 300 nm to about 400 nm, e.g. in the range from about 400 nm to about 500 nm, e.g. in the range from about 500 nm to about 1 μm, e.g. in the range from about 1 μm to about 3 μm, e.g. in the range from about 3 μm to about 5 μm, e.g. in the range from about 5 μm to about 10 μm.

According to various embodiments, the at least one pillar structure 208 may be may be composed of or may include a semiconductor material such as, e.g. silicon. According to various embodiments, the at least one pillar structure 208 may include or may be composed of other semiconductor materials such as germanium, silicon germanium, silicon carbide, gallium nitride, indium, indium gallium nitride, indium gallium arsenide, indium gallium zinc oxide, or other elemental and/or compound semiconductors (e.g. a III-V compound semiconductor such as e.g. gallium arsenide or indium phosphide, or a II-VI compound semiconductor or a ternary compound semiconductor or a quaternary compound semiconductor) as desired for a given application. According to various embodiments, the at least one pillar structure 208 may be composed of or may include at least one of a metal, a dielectric material, a piezoelectric material, a piezoresistive material, and a ferroelectric material.

According to various embodiments, as illustrated in FIG. 2, the at least one pillar structure 208 may be implemented as a plurality of pillars extending between the bottom surface 202*b* of the first membrane structure 202 and the top surface 204*a* of the second membrane structure 204. According to various embodiments, the at least one pillar structure 208 do/does not contact and/or touch the electrode element 206, but rather pass through the electrode element 206 via openings or holes 214 in the electrode element 206.

Figure 4B:
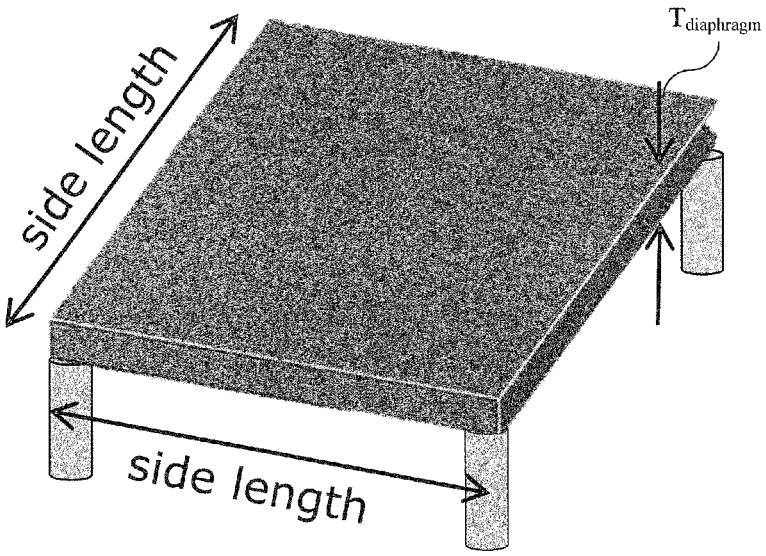
FIG. 4B schematically illustrates a unit diagram of a diaphragm structure segment spanning the area between two or more pillars. The "side length" of the diaphragm structure, its thickness and its intrinsic stress define the amount that the diaphragm structure may deflect under a given applied pressure.
Figure 5:
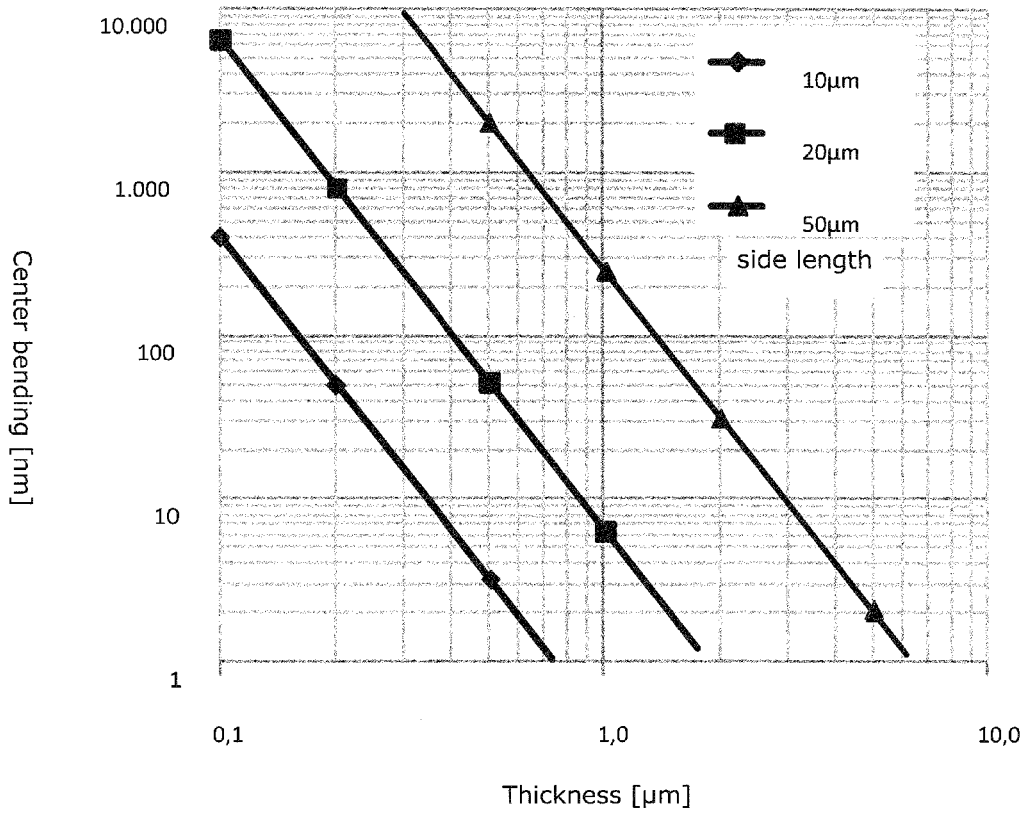
FIG. 5 graphically illustrates the results of calculations for diaphragm deflection under 1 bar pressure (atmospheric pressure) of a unit square segment of a stress-free polysilicon diaphragm for different thicknesses and side lengths.

According to various embodiments, where the at least one pillar structure 208 may be implemented as a plurality of pillars, as illustrated in FIGS. 4A & 4B, the spacing, L1, between the pillars 208 may be in the range from about 1 μm to 50 μm, e.g. in the range from about 1 μm to about 5 μm, e.g. in the range from about 5 μm to about 10 μm, e.g. in the range from about 10 μm to about 20 μm, e.g. in the range from about 20 μm to about 25 μm, e.g. in the range from about 25 μm to about 50 μm.

According to various embodiments, the at least one pillar structure 208 may be integrally formed with the first and second membrane structures 202 and 204, respectively.

According to various embodiments, the first membrane structure 202, the second membrane structure 204, and the at least one pillar structure 208 may form an integral structure of the same material, e.g. silicon.

According to various embodiments, the first membrane structure 202, the second membrane structure 204, and the at least one pillar structure 208 may each be formed in discrete steps during the manufacturing process of the double-membrane MEMS sensor structure 200.

According to various embodiments, the at least one pillar structure 208 may include or may be comprised of a different material from that of the first and second membrane structures 202 and 204, respectively.

According to various embodiments, as illustrated in FIGS. 3A-E, the double-membrane MEMS sensor structure 200 may further include a resilient structure 302.

According to various embodiments, the resilient structure 302 may include a barrier structure 304 which may arranged relative to the first membrane structure 202 and the second membrane structure 204 to form a sealed enclosure around the chamber 203.

According to various embodiments, the barrier structure 304, the first membrane structure 202, and the second membrane structure 204 may form an integral structure of the same material, e.g. silicon.

According to various embodiments, the barrier structure 304, the first membrane structure 202, and the second membrane structure 204 may each be formed in discrete steps during the manufacturing process of the double-membrane MEMS sensor structure 200.

According to various embodiments, the barrier structure 304 may include or may be comprised of a different material from that of the first and second membrane structures 202 and 204, respectively.

According to various embodiments, the barrier structure 304 may be coupled and/or fixed to the support structure 210.

According to various embodiments, the barrier structure 304 may be coupled and/or fixed to the support structure 210.

According to various embodiments, the resilient structure 302 may include a spring support element 306 which may arranged between the a barrier structure 304 and the support structure 210.

According to various embodiments, the spring support element 306 may have displacement tension, at an ambient pressure of 1 Pa, e.g. in the range of about 1 nm/Pa to about 20 nm/Pa, e.g. in the range from about 1 nm/Pa to about 2 nm/Pa, e.g. in the range from about 2 nm/Pa to about 3 nm/Pa, e.g. in the range from about 3 nm/Pa to about 5 nm/Pa, e.g. in the range from about 5 nm/Pa to about 7 nm/Pa, e.g. in the range from about 7 nm/Pa to about 9 nm/Pa, e.g. in the range from about 9 nm/Pa to about 12 nm/Pa, e.g. in the range from about 12 nm/Pa to about 15 nm/Pa, e.g. in the range from about 15 nm/Pa to about 20 nm/Pa.

According to various embodiments, where the double-membrane MEMS sensor structure 200 may be embodied as a MEMS microphone, the microphone's sensitivity may be substantially defined by the displacement tension of the spring support element 306.

According to various embodiments, the spring support element 306 may have a stiffness which is less than the stiffness of the first and second membrane structures 202 and 204, respectively.

Figure 3A:
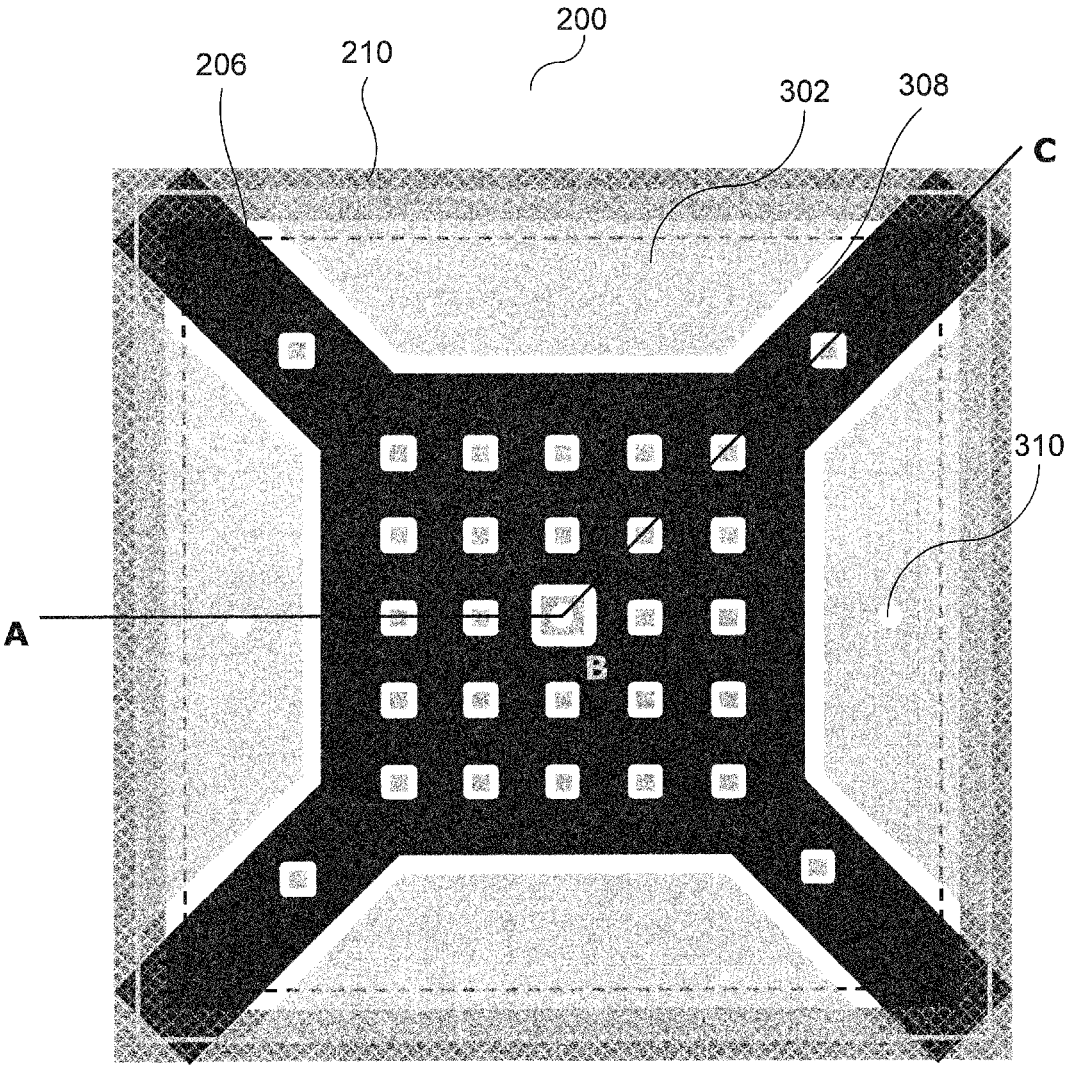
FIG. 3A shows an overhead, schematic cross-section of a double diaphragm MEMS sensor where the counter electrode element is implemented in an X-shaped configuration in accordance with various embodiments.

According to various embodiments, as illustrated in FIG. 3A, electrode element 206 may be coupled to the support structure 210 independently from the resilient structure 302. According to various embodiments, electrode element 206 may be coupled to the support structure 210 through least one void 308 in the resilient structure 302.

According to various embodiments, the electrode element 206 may extend from the chamber 203 through the least one void 308 in the resilient structure 302 and be fixed to and/or integrated in the support structure 210.

According to various embodiments, as illustrated in FIG. 3A, the electrode element 206 may be substantially X-shaped. According to various embodiments, the electrode element 206 may be fixed and/or attached to the support structure 210 by four arms that extend in a substantially X-shaped manner from a central portion of the electrode element 206. According to various embodiments, the electrode element 206 may be fixed and/or attached to the support structure 210 by any other number of arms that may be desirable for a given application.

According to various embodiments, as illustrated in FIGS. 3A-E, the spring support element 306 may be implemented as double-trough structure. According to various embodiments, the double-trough may be implemented where two troughs are arranged such that the valley of the first trough is oriented to a first direction and the valley of the second trough is oriented to a second direction which may be in an opposite direction to the first direction.

According to various embodiments, as illustrated in FIGS. 3A-E, the least one void 308 in the resilient structure 302 may be arranged at a corner and/or corners of the support structure 210, such that the portion of the spring support element 306 arranged on either side of the least one void 308 do not meet. In other words, the least one void 308 in the resilient structure 302 may also include a gap the spring support element 306, through which the electrode element 206 may be mechanically and/or electrically coupled to the support structure 210.

According to various embodiments, as illustrated in FIG. 3A, the resilient structure 302 may include at least one vent hole 310.

According to various embodiments, the least one vent hole 310 may be formed in the spring support element 306. According to various embodiments, the least one vent hole 310 may be configured to facilitate a static pressure equalization between the ambient pressure and the cavity 212.

According to various embodiments, the first and second membrane structures 202 and 204, respectively, may be biased by a pressure difference between the ambient pressure and the pressure within chamber 203, which may be less than the ambient pressure and may be substantially a vacuum.

Figure 3B:
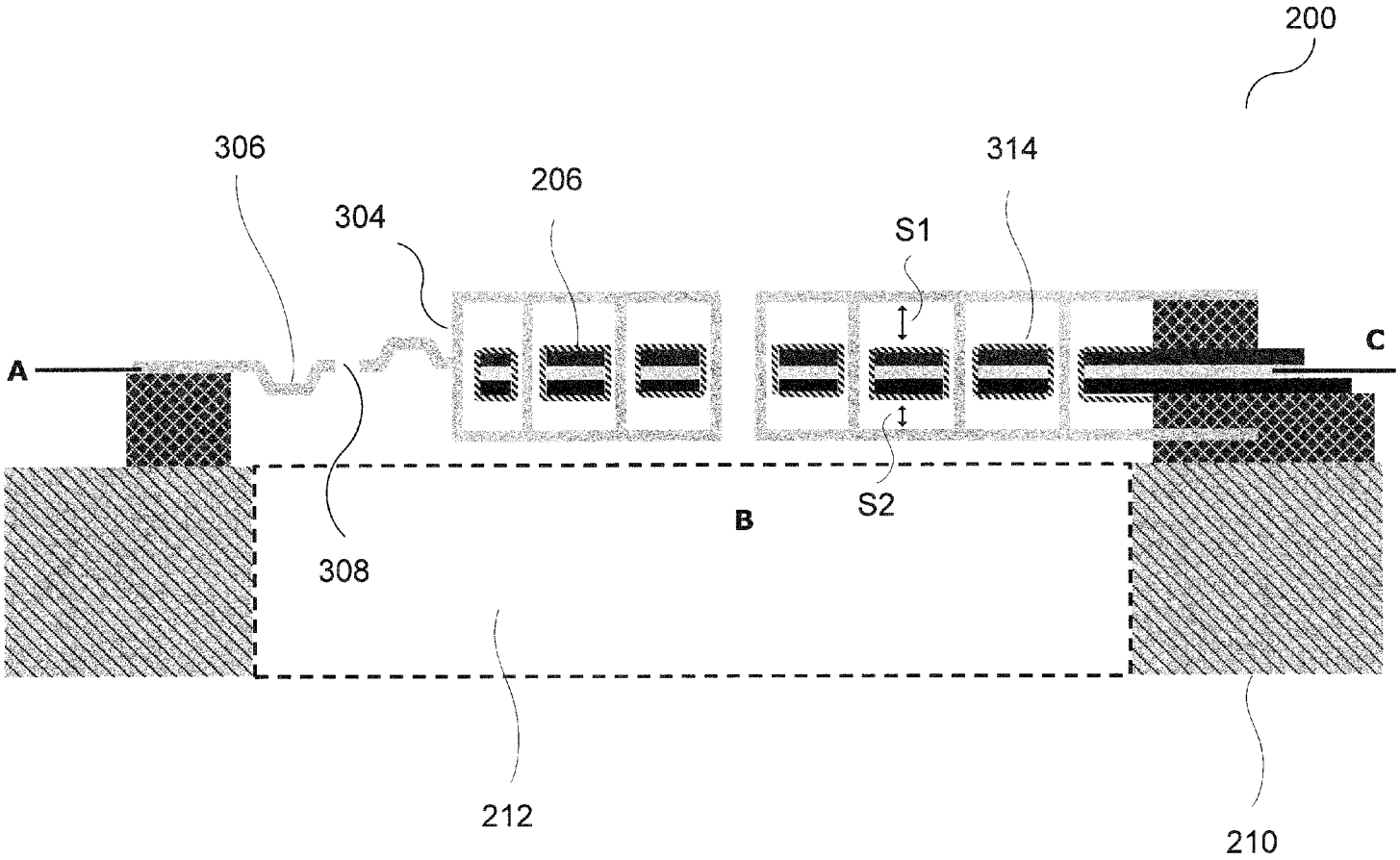
FIG. 3B shows a cross-section of the double diaphragm MEMS sensor structure of FIG. 3A where the double diaphragm MEMS sensor structure is in a rest position in accordance with various embodiments.

According to various embodiments, as illustrated in FIG. 3B, the first and second membrane structures 202 and 204, may assume a rest and/or neutral position when no pressure waves are incident on either the first or second membrane structures 202 and 204, respectively.

According to various embodiments, as illustrated in FIG. 3B, electrode element 206 may include an encapsulation layer 314. The encapsulation layer 314 may be comprised of or may include various dielectrics, such as various dielectric materials, such as, for example, a silicon oxide, silicon nitride, tetraethyl orthosilicate, borophosphosilicate glass, and various plasma oxides. According to various embodiments the encapsulation layer 314 may be comprised of or may include various semiconductor materials such as, silicon dioxide, germanium, silicon germanium, silicon carbide, gallium nitride, indium, indium gallium nitride, indium gallium arsenide, indium gallium zinc oxide, or other elemental and/or compound semiconductors (e.g. a III-V compound semiconductor such as e.g. gallium arsenide or indium phosphide, or a II-VI compound semiconductor or a ternary compound semiconductor or a quaternary compound semiconductor) as desired for a given application.

Figure 3C:
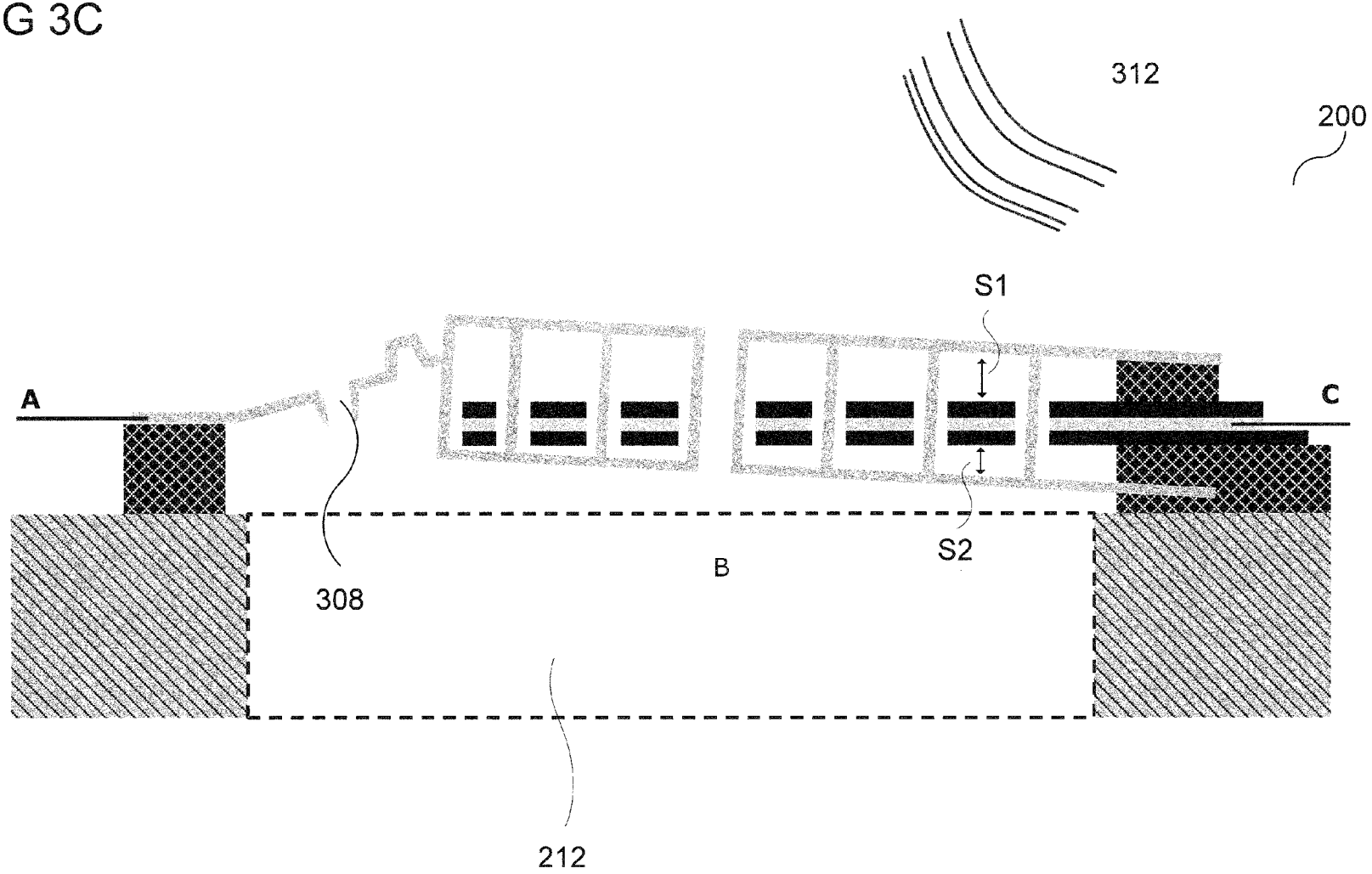
FIGS. 3C and 3D show the double diaphragm MEMS sensor structure of FIG. 3B where the double diaphragm MEMS sensor structure is oscillating and/or deflecting due to the influence of incident pressure waves in accordance with various embodiments.
Figure 3D:
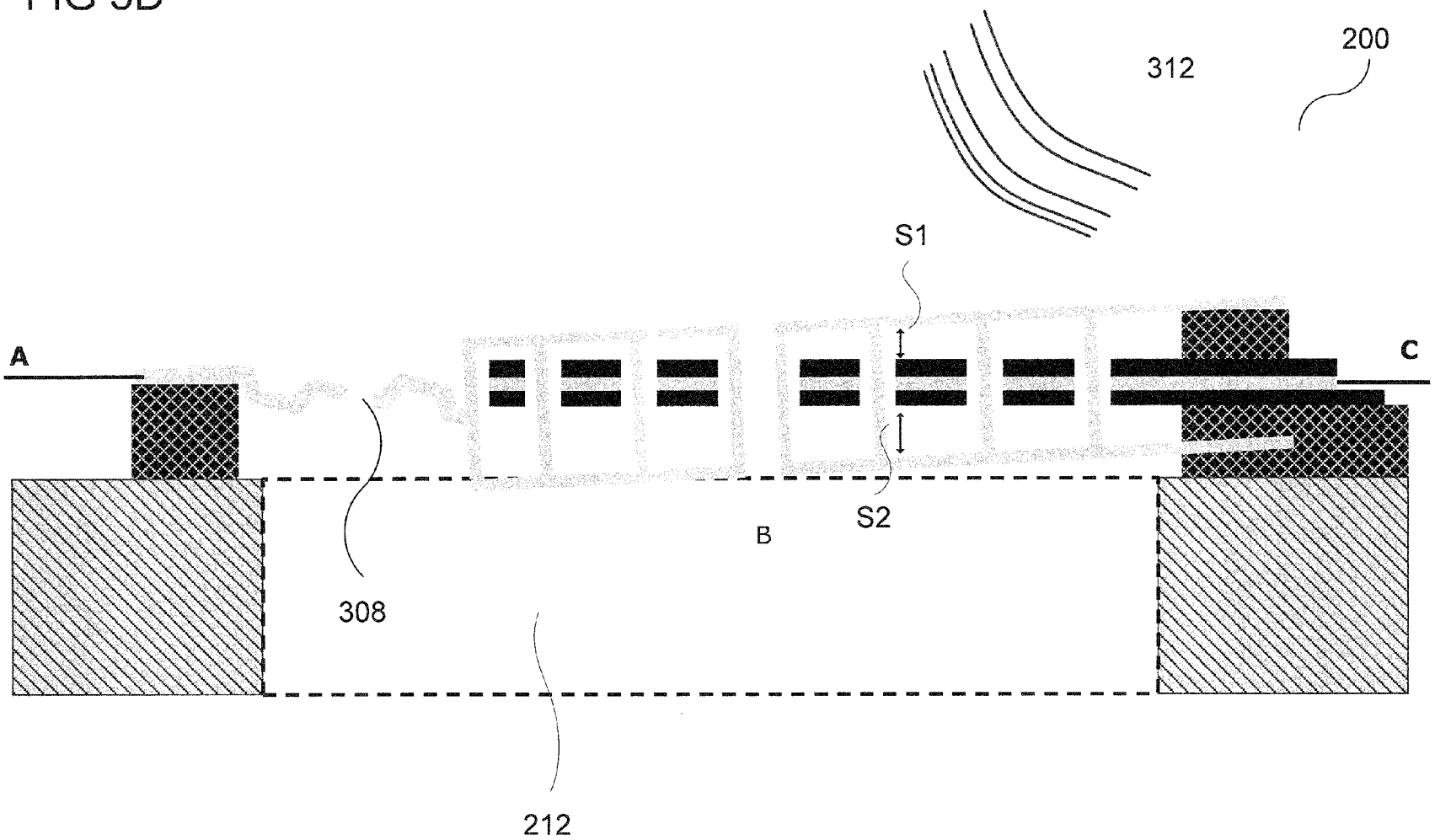

According to various embodiments, as illustrated in FIGS. 3C & 3D, the first and second membrane structures 202 and 204, may deflect and/or oscillate when pressure waves 312 are incident on either the first or second membrane structures 202 and 204, respectively. According to various embodiments, as the first and second membrane structures 202 and 204, may deflect and/or oscillate, the first sensing gap S1 and the second sensing gap S2 may be altered from their rest position distances. According to various embodiments, as the first sensing gap S1 and the second sensing gap S2 are altered, a capacitance between the first membrane structure 202 and the electrode element 206 may likewise be altered, further a capacitance between the second membrane structure 204 and the electrode element may also be altered. According to various embodiments, said changes in capacitance may be used to determine the duration and/or intensity of the pressure waves 312, e.g. where the double-membrane MEMS sensor structure 200 may be configured as a MEMS microphone, converting sound waves into usable electrical signals.

Figure 3E:
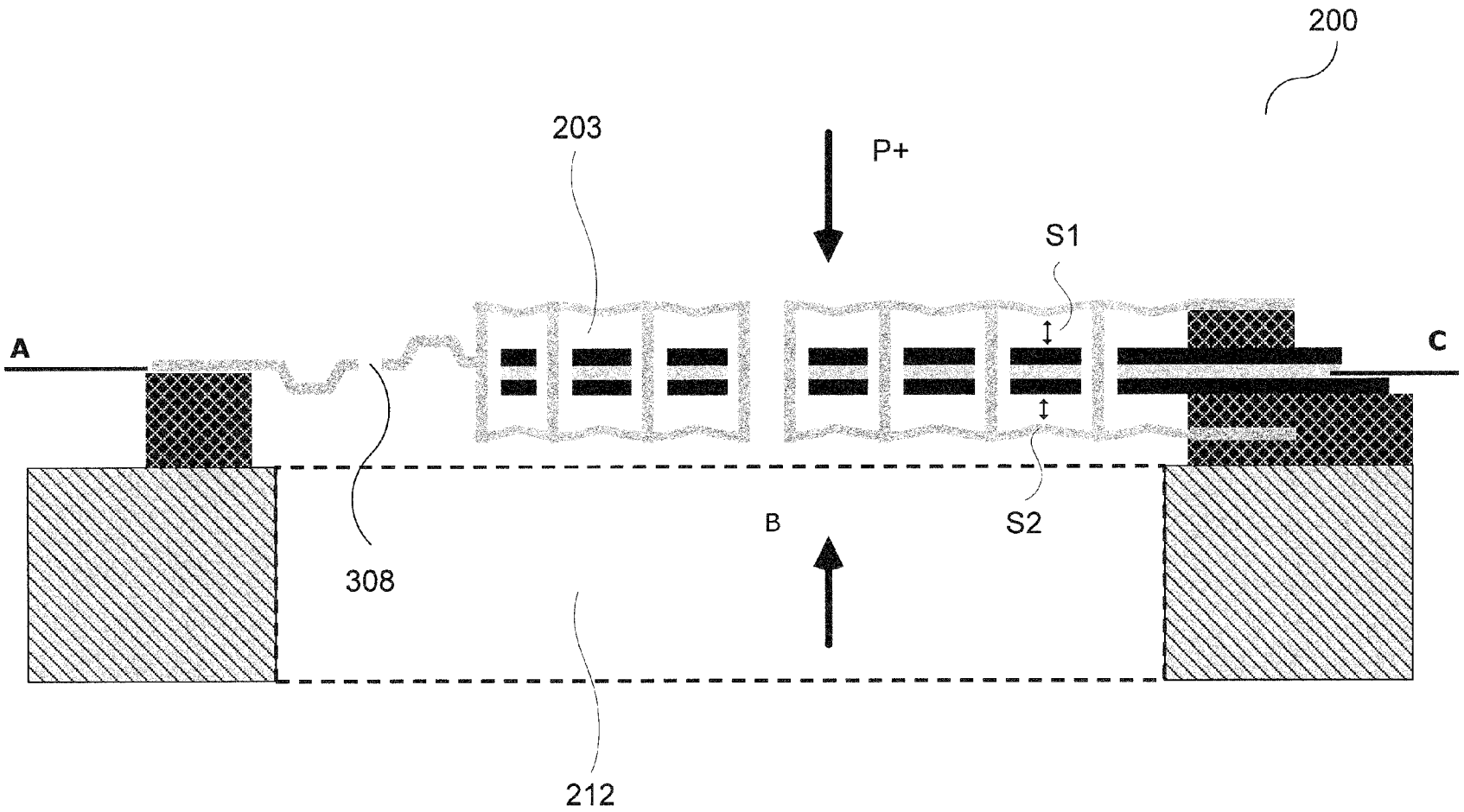
FIG. 3E shows the double diaphragm MEMS sensor structure of FIG. 3B where a change in ambient pressure is causing the diaphragm structures to deflect from a rest position in accordance with various embodiments.

According to various embodiment, as illustrated in FIG. 3E, an increased ambient pressure, P+, outside the chamber 203 may cause the first and second membrane structures 202 and 204 to deflect toward the electrode element 206. According to various embodiments, as the first and second membrane structures 202 and 204 deflect toward the electrode element 206, the first sensing gap S1 and the second sensing gap S2 may be altered from their rest position distances. According to various embodiments, as the first sensing gap S1 and the second sensing gap S2 are altered, a capacitance between the first membrane structure 202 and the electrode element 206 may likewise be altered, further a capacitance between the second membrane structure 204 and the electrode element may also be altered. According to various embodiments, said changes in capacitance may be used to determine the a change in the ambient pressure surrounding the double-membrane MEMS sensor structure 200, e.g. where the double-membrane MEMS sensor structure 200 may be configured as a MEMS pressure sensor.

Figure 6:
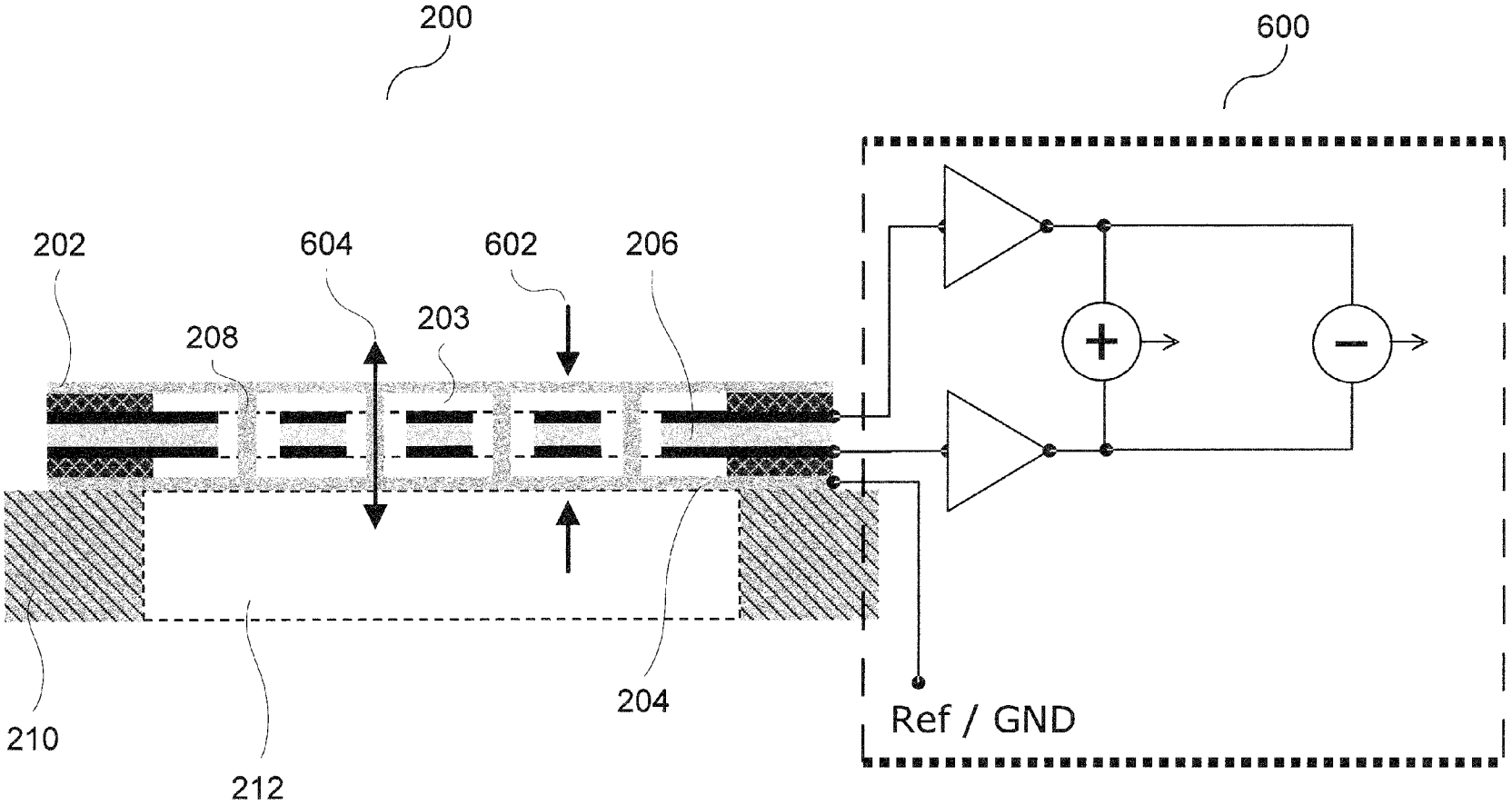
FIG. 6 shows a cross sectional view of a double diaphragm MEMS sensor structure including an optional processing circuit in accordance with various embodiments.

According to various embodiments, as shown in FIG. 6, an change in ambient pressure, (designated with reference numeral 602), outside the chamber 203 may cause the first membrane structure 202 and the second membrane structure 204 to deflect, either toward the electrode element 206 if there is an increase in ambient pressure 602, or away from the electrode element 206 if there is a decrease in ambient pressure 602. According to various embodiments, an electrical signal may be generated by the deflection of the first membrane structure 202 and the second membrane structure 204. The signals may then be compared by the exemplary processing circuit 600 and converted to useable information as may be desirable for a given application, e.g. sensing a change in pressure.

According to various embodiments, as shown in FIG. 6, sound waves (not shown), incident on the chamber 203 may cause the chamber to deflect relative to the electrode element 206, e.g. as shown in FIG. 1B, as the chamber 203 deflects due to the sound waves, the first membrane structure 202 may deflect in a direction substantially toward the electrode element 206 while the second membrane structure 204 may simultaneously be deflected in substantially the same direction as the first membrane structure 202 and therefore may move away from the electrode element 206.

According to various embodiments, electrical signals may be generated by the movement of membrane structures 202 and 204 relative to the electrode element 206. The signals may then be compared by the processing circuit 600 and converted to useable information as may be desirable for a given application, e.g. detecting the magnitude of pressure waves which may be incident on the sensor structure 200. According to various embodiments, the signals generated by the movement of membrane structures 202 and 204, may be of opposite mathematical sign and out of phase with one another.

According to various embodiments, the exemplary processing circuit 600 may be capable of comparing the signals received from the sensor structure 200 and comparing those signals to allow for the simultaneous sensing of a change in ambient pressure around the sensor structure 200 and the magnitude of pressure waves which may be incident on the sensor structure 200.

Figure 7:
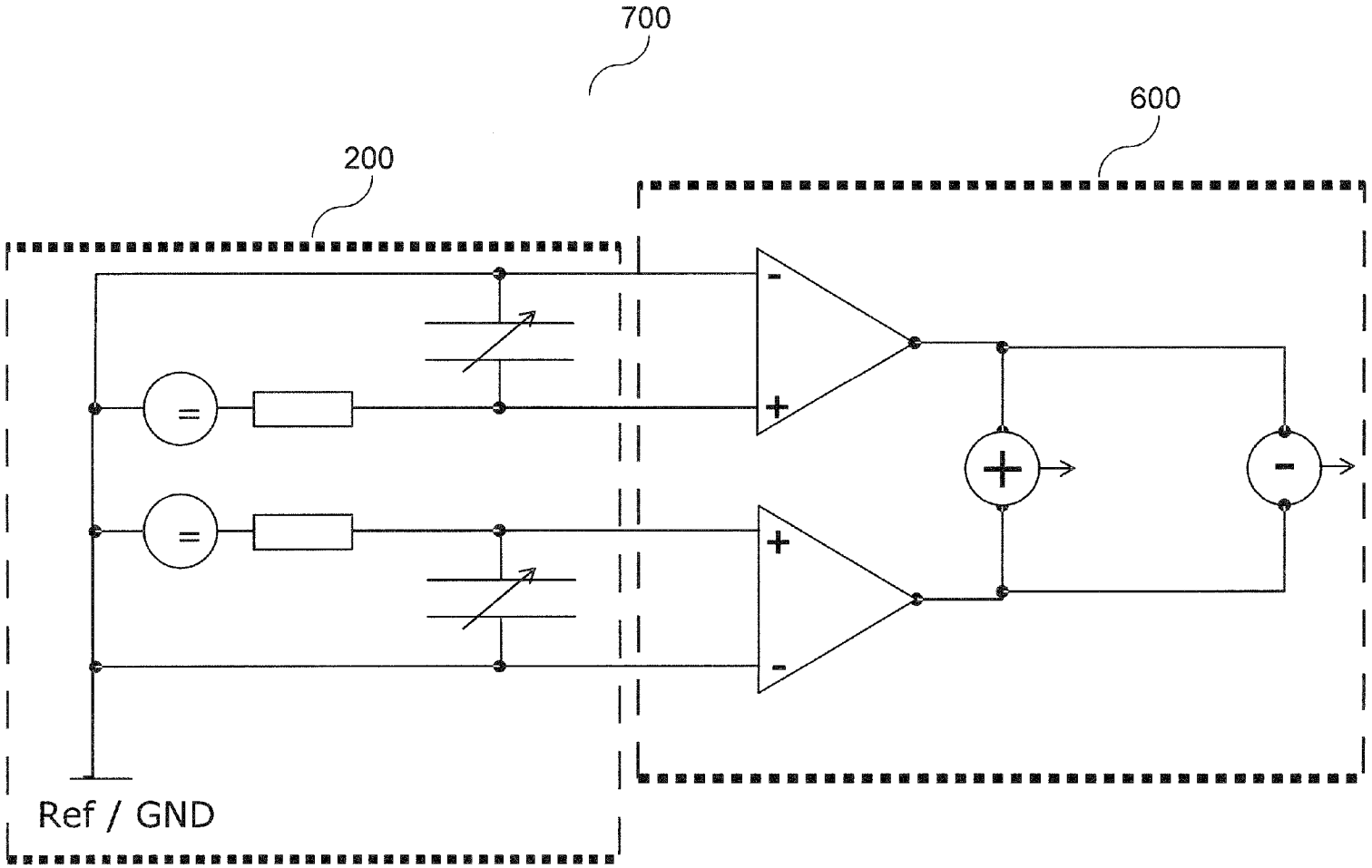
FIG. 7 shows a circuit diagram representation a double diaphragm MEMS sensor structure in accordance with various embodiments.

According to various embodiments, as illustrated in FIG. 7, a combination of the sensor structure 200 and the exemplary processing circuit 600 may be implemented and/or conceptualized as the equivalent circuit 700.

Figure 8:
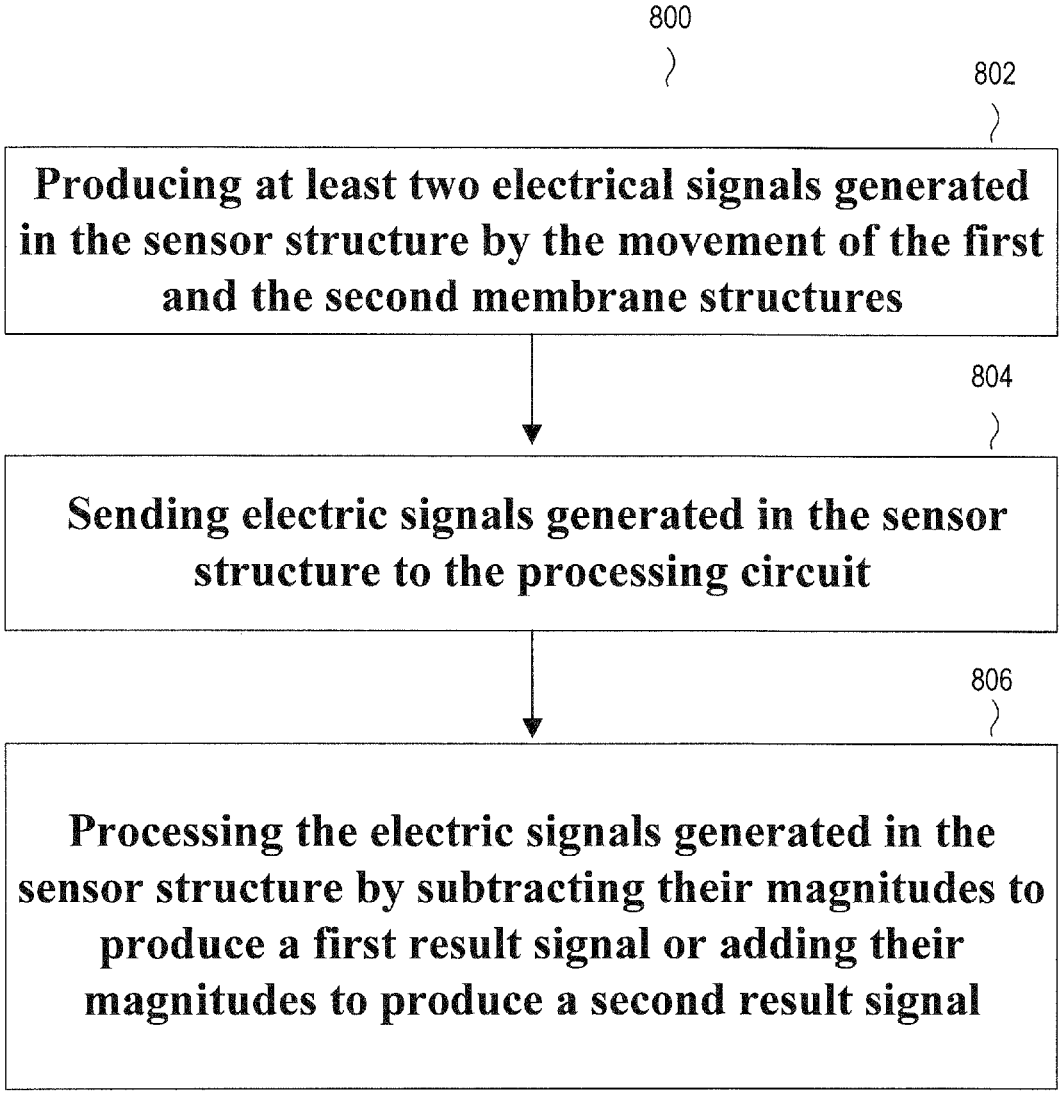
FIG. 8 graphically illustrates, in flow chart form, a method of processing electrical signals which may be produced by a double diaphragm MEMS sensor structure in accordance with various embodiments.

According to various embodiments, as illustrated in FIG. 8, a method 800 of processing of the electric signals generated by the movement of membrane structures 202 and 204 may contain at least the following steps. First, as shown in 802, at least two electrical signals may be generated by the movement of the first membrane structure 202 and the second membrane structure 204. Second, as shown in 804, the at least two electrical signals may be sent from the sensor structure 200 to the exemplary processing circuit 600. Third, as shown in 806, the exemplary processing circuit 600 may process the at least two electrical signals. According to various embodiments, the processing of the at least two electrical signals may include subtracting the magnitude of the signal generated by the movement of the first membrane structure 202 from the magnitude of the signal generated by the movement second membrane structure 204. The result of this subtraction by the exemplary processing circuit 600 may be a first result signal 806. According to various embodiments, the magnitude of the first result signal 806 may be proportional to the magnitude of pressure waves which may be incident on the sensor structure 200. In other words, the magnitude of an electric signal which may be generated by the movement of the first membrane structure 202 may be subtracted from the magnitude of an electric signal which may be generated by the movement of the second membrane structure 204 and the result of this subtraction may be the first result signal 806 which, in turn, may be proportional to the sound pressure level (SPL) exerted by pressure waves which may be incident on the sensor structure 200. According to various embodiments, the processing of the at least two electrical signals may include adding the magnitude of the signal generated by the movement of the first membrane structure 202 to the magnitude of the signal generated by the movement second membrane structure 204. The result of this addition by the exemplary processing circuit 600 may be a second result signal 808. According to various embodiments, the magnitude of the second result signal 808 may be proportional to change in ambient pressure 602 outside the chamber 203 of the sensor structure 200. In other words, the magnitude of an electric signal which may be generated by the movement of the first membrane structure 202 may be added to the magnitude of an electric signal which may be generated by the movement of the second membrane structure 204 and the result of this addition may be the second result signal 804 which, in turn, may be proportional to a change in ambient pressure 602, outside the chamber 203 of the sensor structure 200.

Figure 9:
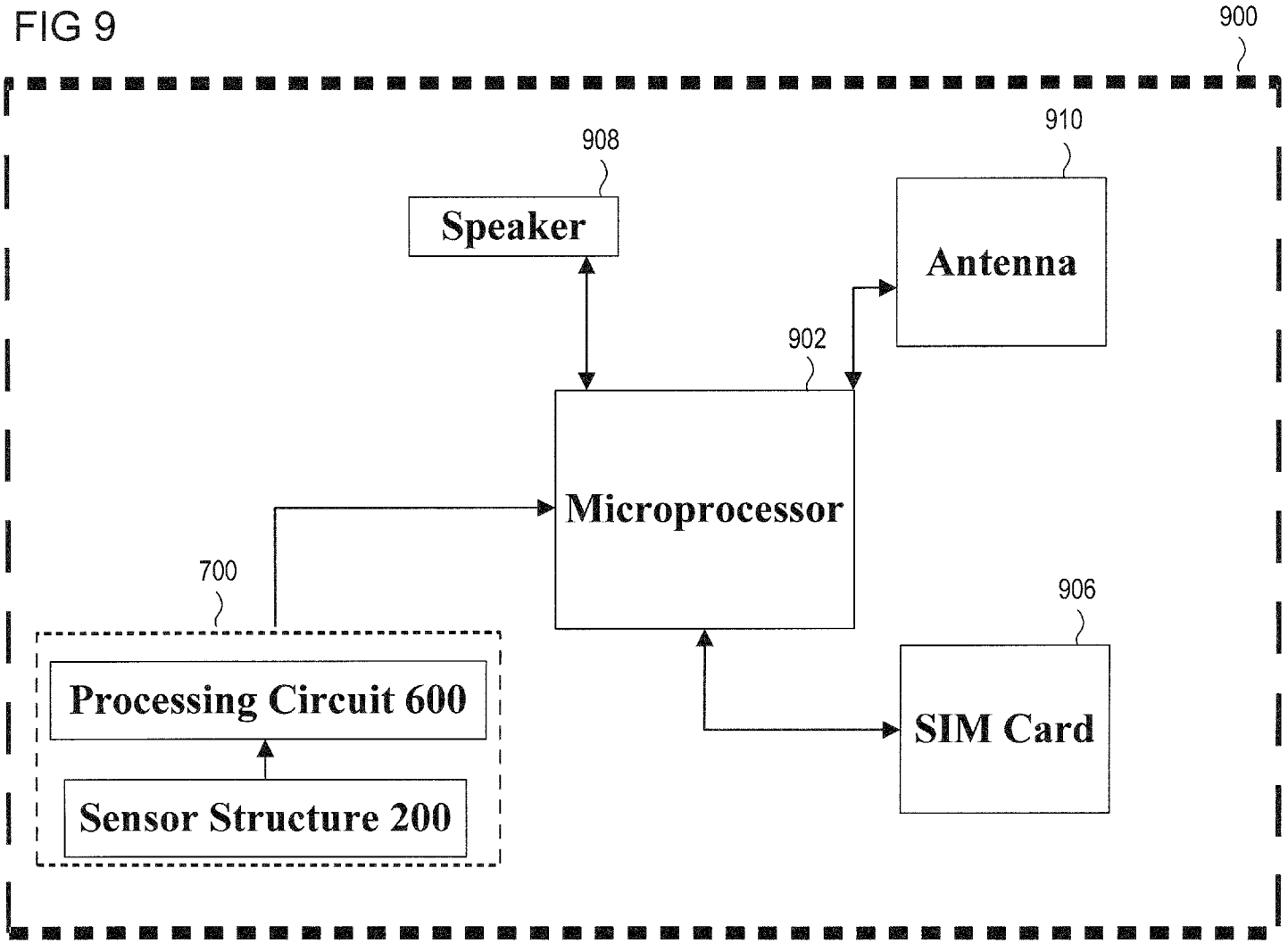
FIG. 9 shows a block diagram of a double diaphragm MEMS sensor structure integrated into a cellular telephone device in accordance with various embodiments.
Figure 10A:
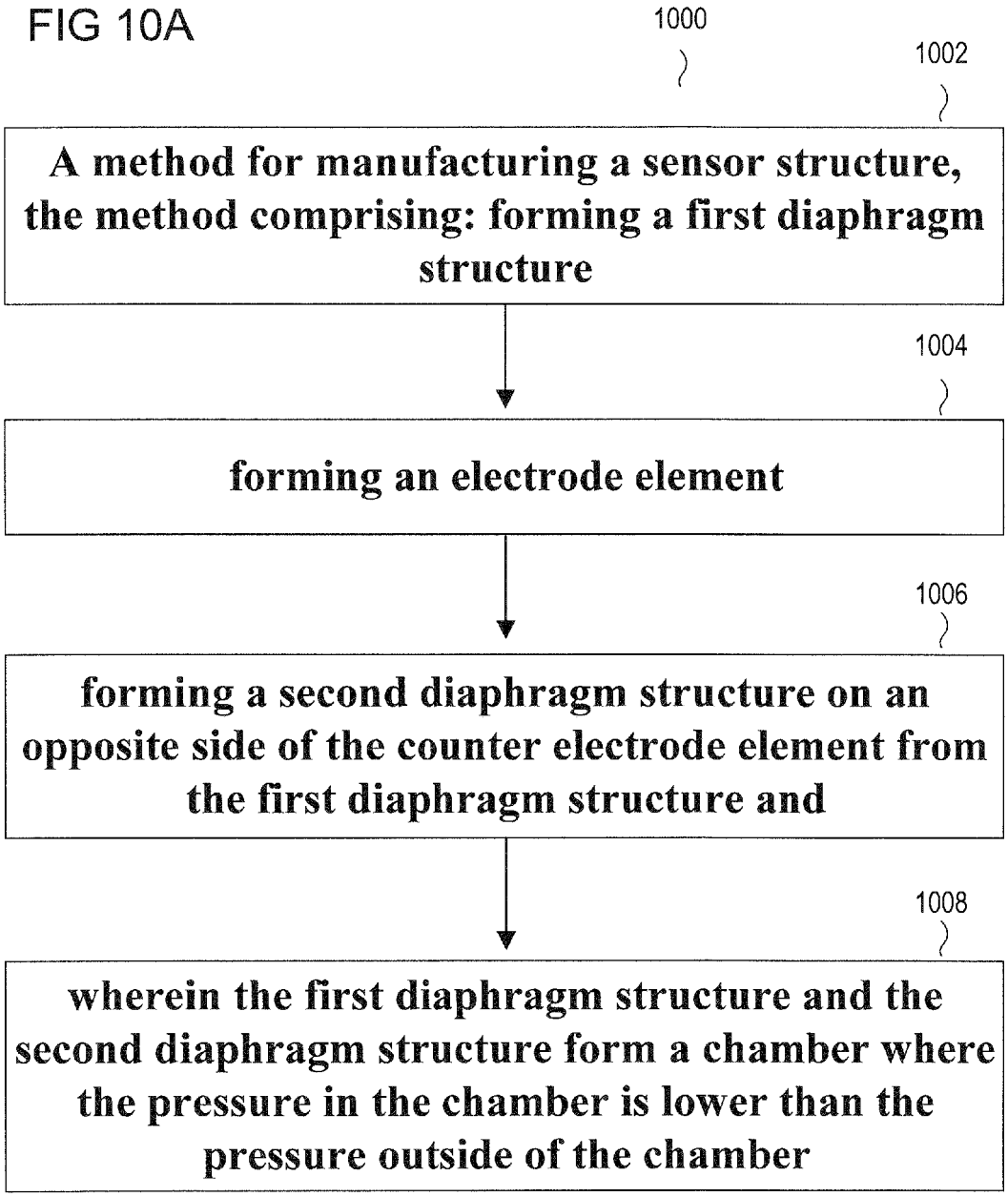
FIGS. 10A-10C graphically illustrate, in flow chart form, a method of constructing a double diaphragm MEMS sensor structure in accordance with various embodiments.
Figure 10B:
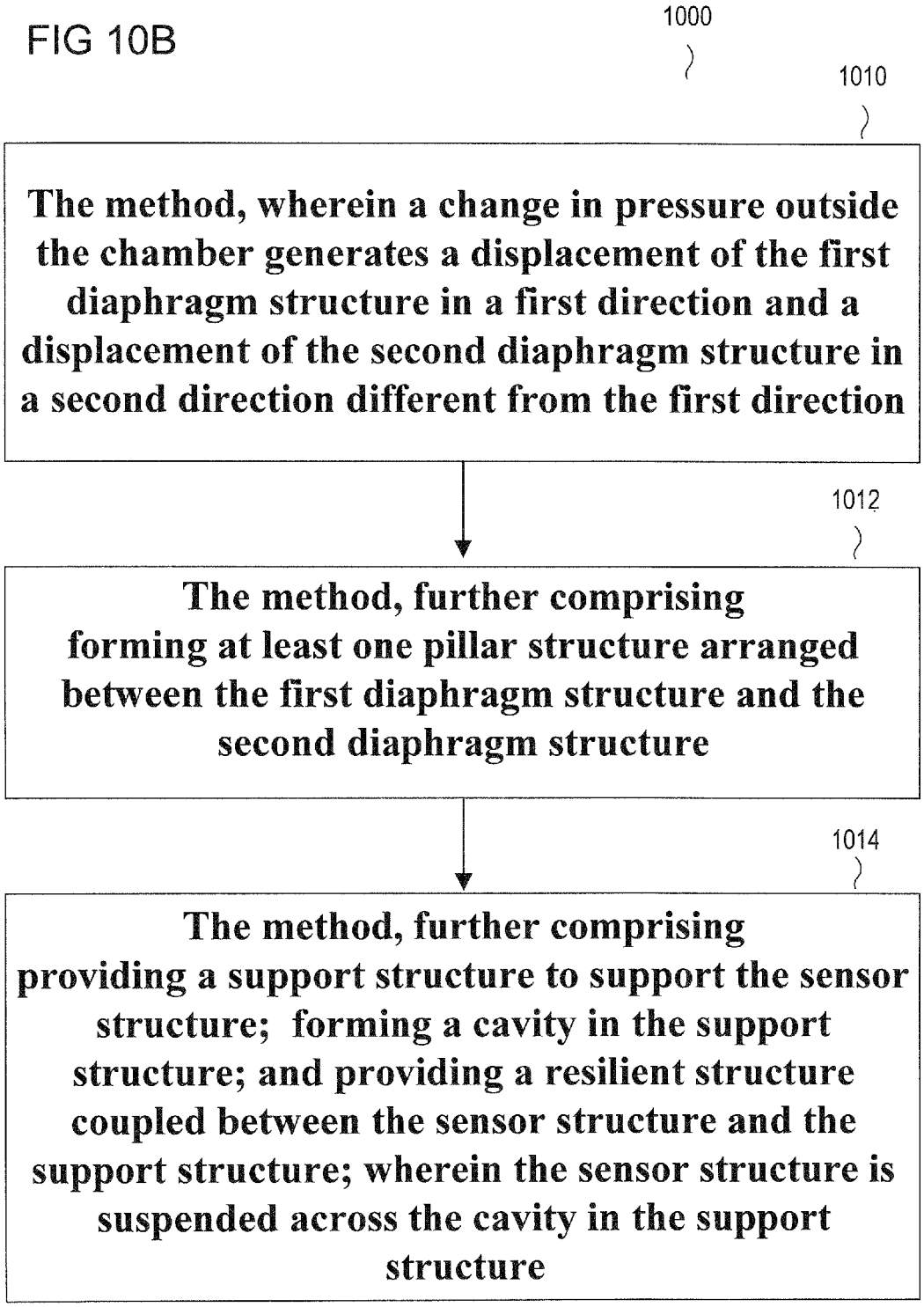
Figure 10C:
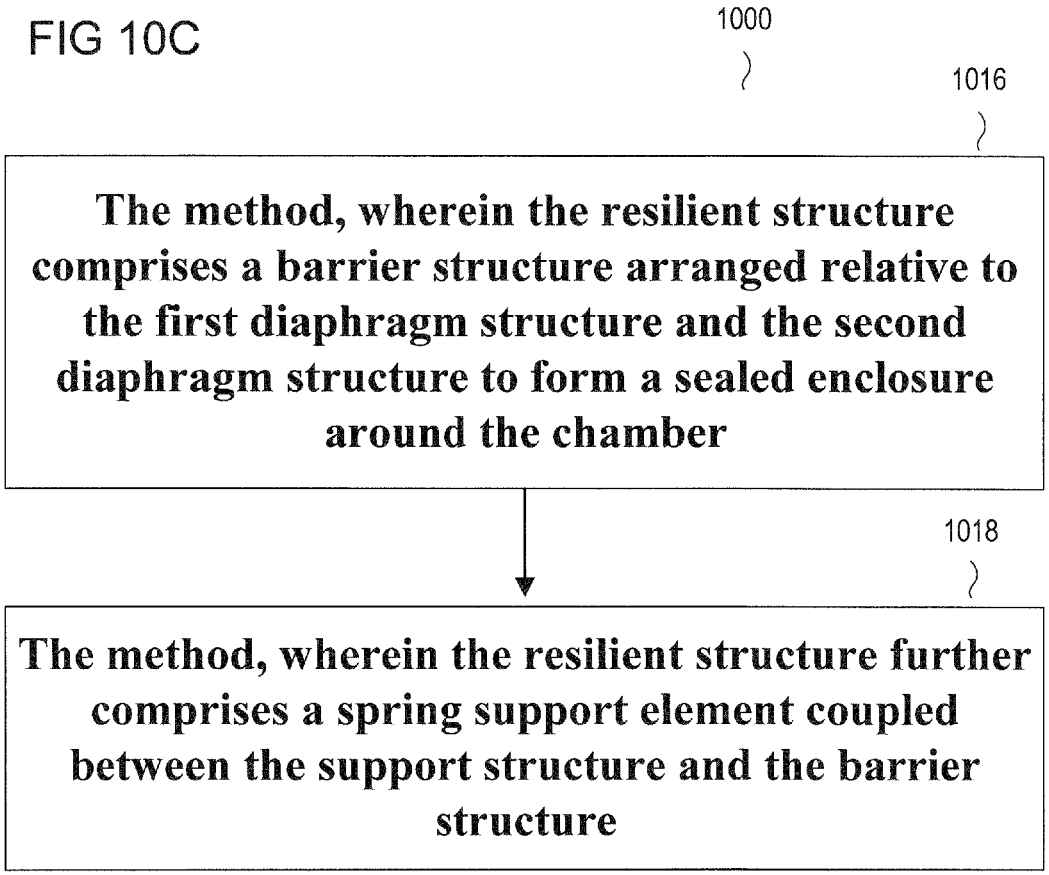

According to various embodiments, as illustrated in FIG. 9, the equivalent circuit 700 may be implemented in various electronic devices, e.g. a cellular telephone 900. According to various embodiments, the sensor structure 200 may transmit information to the cellular telephone 900 via the exemplary processing circuit 600. For example, the exemplary processing circuit 600 may be configured to transmit the first result signal 806 to further processing circuitry, such as, a microprocessor 902 which may be the main processing chip of the cellular telephone 900. Additionally, the exemplary processing circuit 600 may likewise be configured to transmit the second result signal 808 to the microprocessor 902. Further the exemplary processing circuit 600 may be configured to transmit both the first and second result signals 806 and 808, respectively, to the microprocessor 902. Additionally, the exemplary processing circuit 600 may be configured to transmit any combination of signals to a variety of additional processing devices as may be desired for a given application. According to various embodiments, the equivalent circuit 700 may be implemented in various other electronic devices such as Global Positioning System (GPS) devices, Subscriber Identity Module (SIM) cards, digital image capture devices, and various other devices as may be desirable for a given application. According to various embodiments, as illustrated in FIGS. 10A-10C, a method 1000 for forming a sensor structure is disclosed. The method 1000 may include, as shown in 1002, forming a first diaphragm structure; forming an electrode element as shown in 1004; forming a second diaphragm structure on an opposite side of the counter electrode element from the first diaphragm structure as shown in 1006; and providing a low pressure region between the first diaphragm structure and the second diaphragm structure as shown in 1008. According to various embodiments, as shown in 1010, a change in pressure outside the chamber may generate a displacement of the first diaphragm structure in a first direction and a displacement of the second diaphragm structure in a second direction different from the first direction. According to various embodiments, the method 1000 may further include, as shown in 1012, forming at least one pillar structure arranged between the first diaphragm structure and the second diaphragm structure. According to various embodiments, the method 1000 may further include, as shown in 1014, providing a support structure to support the sensor structure; forming a cavity in the support structure; providing a resilient structure coupled between the sensor structure and the support structure; and suspending the sensor structure across the cavity in the support structure. According to various embodiments, as shown in 1016, the resilient structure may include a barrier structure arranged relative to the first membrane structure and the second membrane structure to form a sealed enclosure around the chamber. According to various embodiments, as shown in 1018, the resilient structure may further include a spring support element coupled between the support structure and the barrier structure.

According to various embodiments, a sensor structure, including: a first diaphragm structure, an electrode element, a second diaphragm structure arranged on an opposite side of the electrode element from the first diaphragm structure, and a circuit configured to process at least one signal generated by a deflection of the first diaphragm structure and a deflection of the second diaphragm structure is disclosed.

According to various embodiments, the first diaphragm structure and second diaphragm structure are arranged to form a chamber where the pressure in the chamber is lower than the pressure outside of the chamber.

According to various embodiments, the sensor structure may further include at least one pillar structure arranged between the first diaphragm structure and the second diaphragm structure.

According to various embodiments, said at least one pillar structure is arranged to electrically couple the first diaphragm structure to the second diaphragm structure.

According to various embodiments, said at least one pillar structure at least partially intersects the chamber formed by the first diaphragm structure and the second diaphragm structure.

According to various embodiments, said electrode element is at least partially arranged in the chamber formed by the first diaphragm structure and the second diaphragm structure.

According to various embodiments, said pressure in the chamber formed by the first diaphragm structure and the second diaphragm structure is substantially a vacuum.

According to various embodiments, said sensor structure may further include: a support structure supporting the sensor structure and a resilient structure coupled between the sensor structure and the support structure.

According to various embodiments, said support structure includes a micro-electro-mechanical system.

According to various embodiments, said resilient structure includes a barrier structure arranged relative to the first diaphragm structure and the second diaphragm structure to form a sealed enclosure around the chamber.

According to various embodiments, said resilient structure further includes a spring support element coupled between the support structure and the barrier structure.

According to various embodiments, a surface of the first diaphragm structure is fixed to a surface of the support structure.

According to various embodiments, said electrode element is fixed to the support structure through at least one void in the resilient structure.

According to various embodiments, said sensor structure may further include: a cavity formed in the support structure.

According to various embodiments, said sensor structure is suspended across the cavity in the support structure.

According to various embodiments, a method for forming a sensor structure, the method may include: forming a first diaphragm structure; forming an electrode element; forming a second diaphragm structure on an opposite side of the counter electrode element from the first diaphragm structure; and providing a low pressure region between the first diaphragm structure and the second diaphragm structure.

According to various embodiments, said method may further include: forming at least one pillar structure arranged between the first diaphragm structure and the second diaphragm structure.

According to various embodiments, said method may further include: providing a support structure to support the sensor structure; forming a cavity in the support structure; and providing a resilient structure coupled between the sensor structure and the support structure.

According to various embodiments, said method may further include: suspending the sensor structure across the cavity in the support structure.

According to various embodiments, said method, where the resilient structure includes a barrier structure arranged relative to the first diaphragm structure and the second diaphragm structure to form a sealed enclosure around the chamber.

According to various embodiments, said method, where the resilient structure further includes a spring support element coupled between the support structure and the barrier structure.

While the disclosure has been particularly shown and described with reference to specific embodiments, it should be understood by those skilled in the art that various changes in form and detail may be made therein without departing from the spirit and scope of the disclosure as defined by the appended claims. The scope of the disclosure is thus indicated by the appended claims and all changes which come within the meaning and range of equivalency of the claims are therefore intended to be embraced.

What is claimed is:

1. A sensor structure for sensing pressure waves and a change in ambient pressure, comprising:

a first diaphragm structure;

an electrode element;

a second diaphragm structure arranged on an opposite side of the electrode element from the first diaphragm structure; and a circuit configured to process at least one signal generated by a deflection of the first diaphragm structure and a deflection of the second diaphragm structure;

wherein the first diaphragm structure and the second diaphragm structure form a chamber where the pressure in the chamber is lower than the pressure outside of the chamber.

2. The sensor structure of claim 1, further comprising:

at least one pillar structure arranged between the first diaphragm structure and the second diaphragm structure.

3. The sensor structure of claim 2, wherein the at least one pillar structure is arranged to electrically couple the first diaphragm structure to the second diaphragm structure.

4. The sensor structure of claim 2, wherein the at least one pillar structure at least partially intersects the chamber formed by the first diaphragm structure and the second diaphragm structure.

5. The sensor structure of claim 1, wherein the electrode element is at least partially contained by the chamber formed by the first diaphragm structure and the second diaphragm structure.

6. The sensor structure of claim 1, wherein the pressure in the chamber formed by the first diaphragm structure and the second diaphragm structure is substantially a vacuum.

7. The sensor structure of claim 1, further comprising:

a support structure supporting the sensor structure; and a resilient structure coupled between the sensor structure and the support structure.

8. The sensor structure of claim 7, wherein the support structure comprises a micro-electro-mechanical system.

9. The sensor structure of claim 7, wherein the resilient structure comprises a barrier structure arranged relative to the first diaphragm structure and the second diaphragm structure to form a sealed enclosure around the chamber.

10. The sensor structure of claim 9, wherein the resilient structure further comprises a spring support element coupled between the support structure and the barrier structure.

11. The sensor structure of claim 7, wherein a surface of the first diaphragm structure is fixed to a surface of the support structure.

12. The sensor structure of claim 7, wherein the electrode element is fixed to the support structure through at least one void in the resilient structure.

13. The sensor structure of claim 7, further comprising:

a cavity formed in the support structure.

14. The sensor structure of claim 13, wherein the sensor structure is suspended across the cavity in the support structure.

* * * * *